US005903287A

United States Patent [19]

Ishikawa et al.

[11] Patent Number: 5,903,287

[45] Date of Patent: May 11, 1999

[54] INK JET RECORDING APPARATUS WITH SIMPLIFIED SUCTION RECOVERY DEVICE

[75] Inventors: Tetsuya Ishikawa; Tetsuji Kurata, both of Yokohama, Japan

[73] Assignee: Canon Kabushiki Kaisha, Tokyo, Japan

[21] Appl. No.: 08/796,674

[22] Filed: Feb. 6, 1997

Related U.S. Application Data

[63] Continuation of application No. 08/264,495, Jun. 23, 1994, abandoned.

[30] Foreign Application Priority Data

Jun. 25, 1993 [JP] Japan ..... 5-155401
Jun. 28, 1993 [JP] Japan ..... 5-157583

[51] Int. Cl.[6] ..... B41J 2/165

[52] U.S. Cl. ..... 347/24

[58] Field of Search ..... 347/22, 23, 29, 347/30, 31, 33, 24, 43, 90, 36

[56] References Cited

U.S. PATENT DOCUMENTS

| | | | |
|---|---|---|---|
| 4,313,124 | 1/1982 | Hara | 347/57 |
| 4,345,262 | 8/1982 | Shirato et al. | 347/10 |
| 4,459,600 | 7/1984 | Sato et al. | 347/47 |
| 4,463,359 | 7/1984 | Ayata et al. | 347/56 |
| 4,492,969 | 1/1985 | Terasawa | 347/30 |
| 4,506,277 | 3/1985 | Terasawa | 347/30 |
| 4,510,510 | 4/1985 | Terasawa | 347/30 |
| 4,543,589 | 9/1985 | Terasawa | 347/31 |
| 4,558,333 | 12/1985 | Sugitani et al. | 347/65 |
| 4,608,577 | 8/1986 | Hori | 347/66 |
| 4,723,129 | 2/1988 | Endo et al. | 347/56 |
| 4,728,970 | 3/1988 | Terasawa | 347/30 |
| 4,740,796 | 4/1988 | Endo et al. | 347/56 |
| 5,128,690 | 7/1992 | Nozawa | 347/30 |
| 5,146,243 | 9/1992 | English et al. | 347/29 |
| 5,164,748 | 11/1992 | Katayanagi et al. | 347/30 |
| 5,166,708 | 11/1992 | Hirano et al. | 347/24 |
| 5,202,702 | 4/1993 | Terasawa et al. | 347/32 |
| 5,426,456 | 6/1995 | Kuelzer et al. | 347/30 |
| 5,614,929 | 3/1997 | Dangelo et al. | 347/30 |
| 5,625,385 | 4/1997 | Suzuki | 347/24 |

FOREIGN PATENT DOCUMENTS

| | | | |
|---|---|---|---|
| 0442440 | 8/1991 | European Pat. Off. . | |
| 0 585 923 | 3/1994 | European Pat. Off. | B41J 2/165 |
| WO91/10570 | 7/1991 | Germany . | |
| 54-056847 | 5/1979 | Japan . | |
| 59-045163 | 3/1982 | Japan . | |
| 59-123670 | 7/1984 | Japan . | |
| 59-138461 | 8/1984 | Japan . | |
| 60-071260 | 4/1985 | Japan . | |
| 63-224957 | 9/1988 | Japan | B41J 3/04 |
| 01-264853 | 10/1989 | Japan | 347/24 |
| 4-307257 | 10/1992 | Japan | 347/33 |
| 04-344258 | 11/1992 | Japan | 347/24 |
| 4-338552 | 11/1992 | Japan | 347/33 |
| 6-79877 | 3/1994 | Japan | B41J 2/165 |
| 6-191112 | 7/1994 | Japan | B41J 19/18 |
| 7-68795 | 3/1995 | Japan | B41J 2/18 |

OTHER PUBLICATIONS

IBM Technical Disclosure Bulletin, "Nozzle Guard and Maintenance Station for Drop–On–Demand Printheads," vol. 27, No. 12, May 1985.

*Primary Examiner*—Benjamin R. Fuller
*Assistant Examiner*—Craig A. Hallaiher
*Attorney, Agent, or Firm*—Fitzpatrick, Cella, Harper & Scinto

[57] ABSTRACT

In the discharge recovery device for use in an ink jet recording apparatus utilizing plural different inks, there are provided caps for covering the recording heads, in a number corresponding to the number of inks, but suction pumps are provided in a fewer number and made selectively connectable to the caps, in order to simplify the recovery device.

18 Claims, 21 Drawing Sheets

INK JET RECORDING APPARATUS WITH SIMPLIFIED SUCTION RECOVERY DEVICE

This application is a continuation of application Ser. No. 08/264,495 filed Jun. 23, 1994, now abandoned.

BACKGROUND OF THE INVENTION

1. Field of the Invention

The present invention relates to an ink jet recording apparatus equipped with a recovery mechanism for maintaining and recovering satisfactory ink discharge state.

2. Related Background Art

The ink jet recording apparatus achieves printing on paper by discharging liquid ink from a head. As shown in FIG. 25, a carriage 101, supporting a printing head 105 and an ink tank or an ink supply tube, moves in a print-scanning direction to effect printing on the paper.

The conventional ink jet recording apparatus is usually equipped with a cap for tightly covering the nozzle-bearing face of the printing head when the printing operation is not effected, in order to prevent drying of the printing head and leakage of printing ink from the head. Also an ink-sucking pump is usually provided in communication with the cap, for recovering from printing defect resulting from the nozzle clogging with dusts or from air entrusion into the nozzle.

Recently there is becoming popular the apparatus utilizing plural printing heads and inks of plural colors for enabling color printing. There are at least required three colors of cyan, magenta and yellow for full color printing, and the main trend is in the printers utilizing inks of four colors, including black in addition to the above-mentioned three colors. As a result there are provided plural caps for respective printing heads, and the color printer is equipped with four caps.

FIG. 25 is a schematic view of an ink jet recording apparatus, wherein provided are a carriage 101; a main body 102 including a paper transporting unit; a recovery mechanism 103 for the recovery operation for the printing head; and printing heads 105. The carriage 101 is rendered movable along a guide shaft 111, and is driven by a carriage motor 115 through a belt 114. When the main body receives printing data, the carriage 101 effects scanning motion along the guide shaft 111, in order to effect printing on a sheet of paper, to be transported by an unrepresented paper transporting unit. In the vicinity of the carriage there is provided an encoder film 113 for detecting the absolute position of the carriage, and an encoder mounted on the carriage detects the absolute position of the carriage. The home position of the carriage is thus determined.

FIG. 26 is a perspective view of an example of the conventional recovery mechanism, wherein shown are a cap 131; a cap holder 132 supporting the cap; a pump 135; and a lever 136 for activating the pump. FIG. 27 is a cross-sectional view seen in a direction indicated by arrows A' in FIG. 26, wherein illustrated are a cam gear 137 for actuating the lever; and a motor 139 for actuating the cam gear 137. When the printing operation is terminated, the carriage 101 stops in facing relationship to the recovery mechanism, at the home position of the above-mentioned encoder film 113. In this state the recovery motor 139 is activated in the forward direction to rotate the cam gear 137 through a worm gear, whereby the cap holder 132 ascends along a cam groove formed on the lateral face of the cam gear and the cap 131, movably supported by the cap holder, is brought into tight contact with the head 105. Such capping operation prevents the drying of the printing head, thereby maintaining the performance thereof when the printing operation is not in progress. Also reverse rotation of the recovery motor 139 rotates the cam gear 137 to actuate a piston 151 of the pump 135 through the lever 136, thereby generating a negative pressure in the pump. Said negative pressure is transmitted to the interior of the cap, through a suction tube 134 connecting the pump 135 with the cap, thereby sucking ink from the nozzles of the printing head maintained in contact with the cap and thus recovering the printing performance of the printing head.

As explained in the foregoing, the conventional ink jet recording apparatus is equipped with a discharge recovery device for eliminating causes of defective ink discharge, such as the nozzle blocking by ink drying, dusts and bubbles in the ink. Such recovery device principally performs following two functions.

The first function is the ink suction removal, by covering the nozzle-bearing face, containing the nozzles, with the cap made of an elastic material such as rubber and sucking the air inside the cap with the pump or the like, thereby forcedly discharging the ink from the nozzles and thus eliminating the above-mentioned causes.

The second function is the removal of unnecessary ink deposited on the above-mentioned nozzle-bearing face, thus rendering the direction of discharge of ink droplets unstable and deteriorating the print quality. This function is achieved by a wiper blade composed of an elastic member and capable of wiping said nozzle-bearing face or an absorbent member, composed for example of a porous material, and brought into contact with said nozzle-bearing face when required, thereby absorbing and removing said unnecessary ink.

However, when the above-mentioned ink suction removal is executed on the recording head, there results a phenomenon of reverse flow of the ink, remaining in the cap, into the nozzles of the recording head by the ink flow within the cap. For this reason, if there is provided only one discharge recovery device in a recording apparatus capable of discharging plural inks (for example a color ink jet recording apparatus), there may result a drawback of defective print quality because of mixing of different inks.

Such inconvenience may be avoided by sucking a large amount of ink or discharging ink after such sucking, in order to completely eliminate such reverse flowing ink within the step of ink suction removal, but such method leads to an elevated running cost because the ink amount discharged other than the recording purpose increases. Also the used ink tank, for storing thus discharged ink within the recording apparatus, has to be made larger, so that the entire recording apparatus inevitably becomes larger.

Also if the discharge recovery devices are provided respectively corresponding to the inks of different kinds, there results an increased cost due to the increase in number of the component parts, in addition to the increase in dimension of the entire recording apparatus.

In the conventional apparatus, as explained above, four caps are respectively provided with pumps, and, at the ink sucking operation, such four pumps are either simultaneously or independently activated. The former method is associated with drawbacks of wasted ink consumption because the ink suction is executed even on the recording head not requiring such ink suction and of necessity for a larger motor because of the large load, while the latter method is associated with a drawback of requiring a complex driving mechanism for independent activation of the pumps.

As explained in the foregoing, in an ink jet recording apparatus capable of recording with plural inks, the discharge recovery device free from color mixing is contradictory to the compactization of the entire recording apparatus, so that it has been impossible to compactize the ink jet recording apparatus, for example capable of color printing, into a size suitable for use in a notebook-sized personal computer.

Also in the recording apparatus equipped with plural recording heads, the discharge recovery device may be compactized, as disclosed in the U.S. Pat. Nos. 4,492,969, 4,506,277 and 4,510,510, by providing plural caps respectively corresponding to the inks of different kinds and connecting all these caps to a single pump. However, if the level of ink adhesion, resulting for example from ink drying, is different among the plural recording heads, the ink is not sucked from the recording heads with severe ink adhesion but only from those with little ink adhesion, so that the recovery of ink discharge cannot be achieved satisfactorily.

Besides, even if the above-mentioned drawback can be avoided for example by applying a sufficiently large instantaneous suction pressure to the caps, this method effects the recovery of ink discharge also on the recording heads which do not require such recovery, thereby causing unnecessary large ink consumption and thus elevating the running cost.

SUMMARY OF THE INVENTION

The present invention has been reached as a result of investigations of the present inventors for resolving the above-mentioned drawbacks of the prior art, and an object thereof is to provide an ink jet recording apparatus equipped with a compact recovery mechanism of a reduced number of components and of a simplified structure, adapted for use for plural ink discharge ports (nozzles).

Another object of the present invention is to provide an ink jet recording apparatus capable, even in case of effecting recording by discharging respectively different inks from plural discharge ports, of secure recovery of ink discharge without mixing of mutually different inks. The different inks in this text include the inks different in color (as in the case of a color ink jet recording apparatus) and the inks different in luminosity (as in the case of a halftone or gray scale ink jet recording apparatus).

Still another object of the present invention is to provide an ink jet recording apparatus in which a pump, constituting suction means for recovery, can be connected to each of plural caps, thereby enabling selected and concentrated recovery operation for the discharge port requiring such recovery operation and thus minimizing the ink consumption in the recovery operation.

Still another object of the present invention is to provide an ink jet recording apparatus in which the number of pumps, constituting the suction means for recovery operation, is made less than the number of plural caps, thereby reducing the driving load of said pumps and allowing to use a smaller motor for driving the same, and thus contributing to the compactization of the entire apparatus.

Still another object of the present invention is to provide an ink jet recording apparatus enabling the recovery operation within a short time, by providing suction caps in positions close to the printing area.

The above-mentioned objects can be attained, according to the present invention, by an ink jet recording apparatus for effecting recording by discharging ink from plural discharge ports, comprising plural caps for respectively covering said plural discharge ports and suction means for effecting suction from said discharge ports through said caps, wherein the number of said caps is larger than the number of said suction means and said plural caps consist of sucking caps connected to said suction means and non-sucking caps not connected to said suction means.

BRIEF DESCRIPTION OF THE DRAWINGS

FIGS. 9-1 to 9-5 are views showing piston positions in the pump in the states corresponding to the cam chart shown in FIG. 7;

DETAILED DESCRIPTION OF THE PREFERRED EMBODIMENTS

Now the present invention will be clarified in detail by preferred embodiments thereof shown in the attached drawings.

[1st embodiment]

Figure 1:
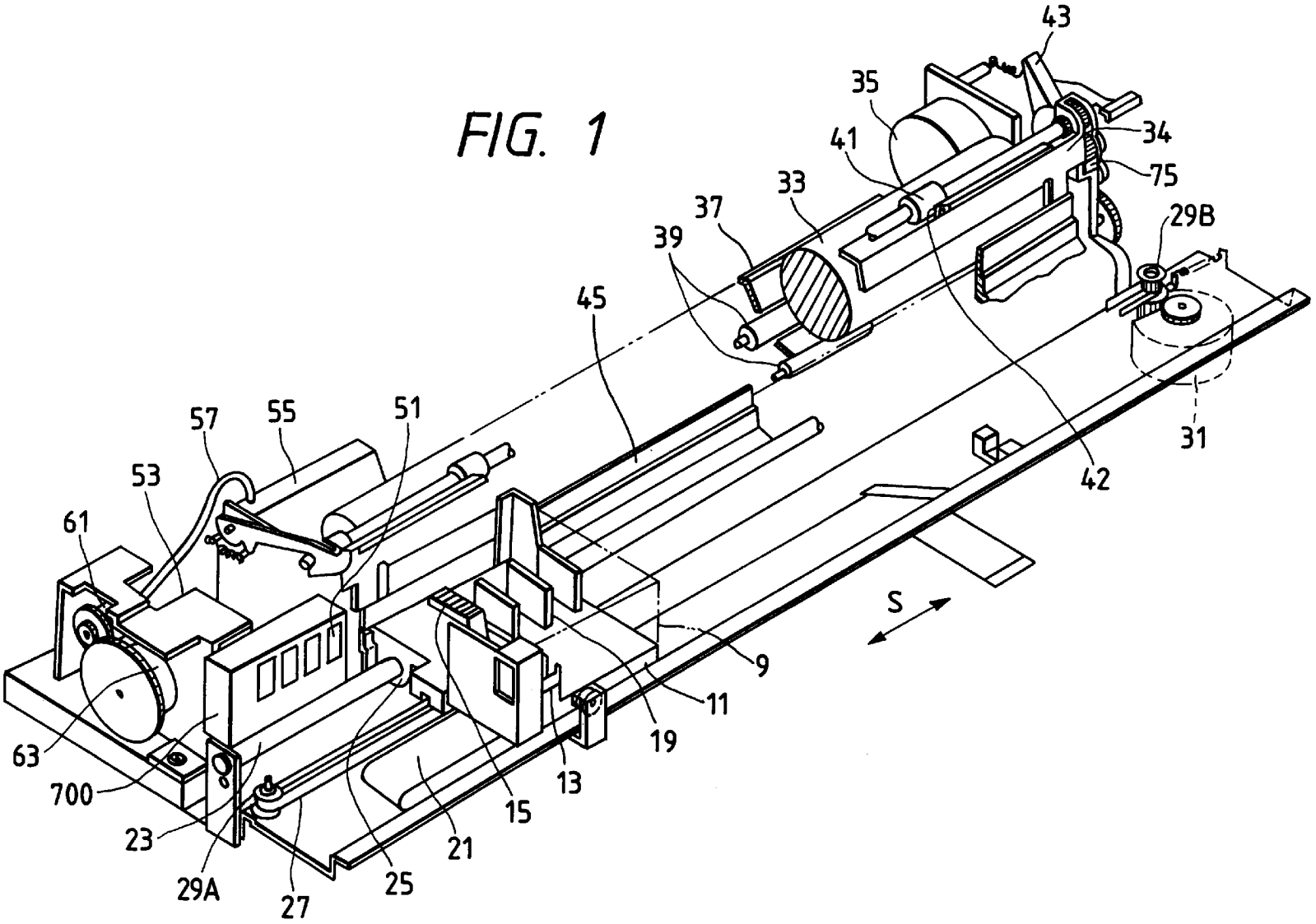
FIG. 1 is a perspective view showing the principal structure of a first embodiment of the ink jet recording apparatus of the present invention.

FIG. 1 is a perspective view showing the principal structure of a first embodiment of the ink jet recording apparatus of the present invention.

The ink jet recording apparatus of the present embodiment, shown in FIG. 1, is provided with a head cartridge 9 employing the bubble (thermal) jet method and including plural ink jet recording heads for color printing. Said head cartridge 9 is mounted, by a hook 13, on a carrier 11 for effecting a scanning motion in a direction S shown in FIG. 1. Said hook 13 may be disengaged by the actuation of a lever 15. The carrier 11 is provided with a support plate 19, supporting a connecting portion for electrical connection with the head cartridge 9, and on said support plate 19 there is mounted a flexible printed circuit board 21 for connection with a control unit in the main body. The carrier 11 is also provided with a bearing 25, in which inserted is a guide shaft 23 for guiding the carrier 11 in the direction S (carrier scanning direction). On both sides of the apparatus there are respectively provided pulleys 29A, 29B supporting a timing belt 27 for moving the carrier 11 in said direction S. The pulley 29B is driven by a carrier motor 31 through a transmission mechanism such as gears.

The ink jet recording apparatus of the present embodiment is further provided with a transport roller 33 for defining the recording surface of a recording medium such as paper and for advancing said recording medium at the recording operation; a transport motor 35 for driving said transport roller 33; a paper pan 37 for guiding the recording medium to the recording position; pinch rollers 39 provided in the transport path of the recording medium, for pressing the same toward the transport roller 33 and transporting the recording medium; a platen 34 positioned opposite to the discharge ports of the head cartridge 9 for defining the recording face of the recording medium; sheet discharge rollers 41 positioned at the downstream side of the recording position, with respect to the transport direction of the recording medium, for guiding the recording medium toward an unrepresented discharge aperture; idler rollers 42 positioned corresponding to the sheet discharge rollers 41 and pressed thereto across the recording medium, thereby enabling the discharge rollers 41 to transport the recording medium; and a release lever 43 for debiasing the pinch rollers 39 and the idler rollers 42 for example at the setting of the recording medium. The platen 34 is rotatably supported at both ends by the shaft of the sheet discharge rollers 41, and is biased, from the stop position of lateral plates 75 toward a front face portion 45 of the paper pan 37.

In an end portion (left end portion in FIG. 1) of the apparatus, where the home position of the recording heads is defined, plural caps 51 of the present invention are so provided as to oppose to faces, bearing ink discharge ports, of the recording heads, and said plural caps are mutually connected by a connecting frame 700. The connecting frame 700 and the caps 51 are composed of an elastic material such as rubber, and are rendered movable in the scanning direction of the carrier. In this embodiment said cap is integrally formed with a blade to be explained later, and such blade-integrated cap 51 is used for protecting the recording head in the non-recording state and for the discharge recovery operation for the recording head.

The cap portion of such blade-integrated cap can be used in the discharge recovery operation of the ink jet recording head principally in the following two manners. The first method consists of maintaining the cap portion of the blade-integrated cap 51 in opposed relationship to the face bearing the discharge ports, and activating energy generating elements, provided inside the ink discharge ports and utilized for ink discharge, thereby discharging the ink from all the discharge ports (predischarge) and thus eliminating the causes of defective discharge, such as dusts, bubbles and ink which has become viscous and is no longer suitable for recording purpose. The second method consists of covering the face, bearing the discharge ports, with the blade-integrated cap 51 and forcedly discharging ink from the discharge ports, thereby eliminating the causes of defective discharge.

On the other hand, the blade portion of the blade-integrated cap is used for wiping off the unnecessary ink deposited on the face, bearing the discharge ports, of the recording head.

The above-mentioned blade-integrated cap has three stopping positions. The first stop position is a retracted position from the recording head, for example at the recording operation, wherein the blade-integrated cap is maintained free of contact with the head cartridge regardless of the position of the carrier. The second stop position is a wiping position, in which the blade portion alone can be in contact with the opening-bearing face of the recording head and the wiping operation is achieved by the movement of the carrier. The third stopping position is a capping position, in which the cap portion is in contact with the opening-bearing face, whereby the ink discharge ports of the recording head are covered with the cap.

A pump 53 is provided for applying a sucking force for forced discharge of the ink and also for sucking the ink received in the blade-integrated cap 51 at the discharge recovery operation by such forced ink discharge or by predischarge. A tube 57 is connected to said pump 53, and the used ink, sucked by the pump 53, is stored in a used ink tank 55 through said tube 57.

Activation of the pump 53 and movement of the blade-integrated cap 51 are achieved by the power of a motor 61, transmitted through a cam device 63.

Figure 2:
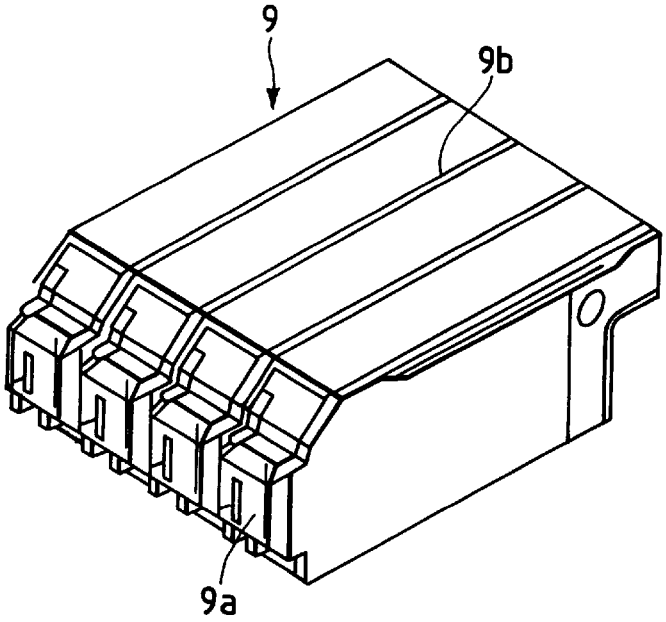
FIG. 2 is an external perspective view of a head cartridge shown in FIG. 1.
Figure 3:
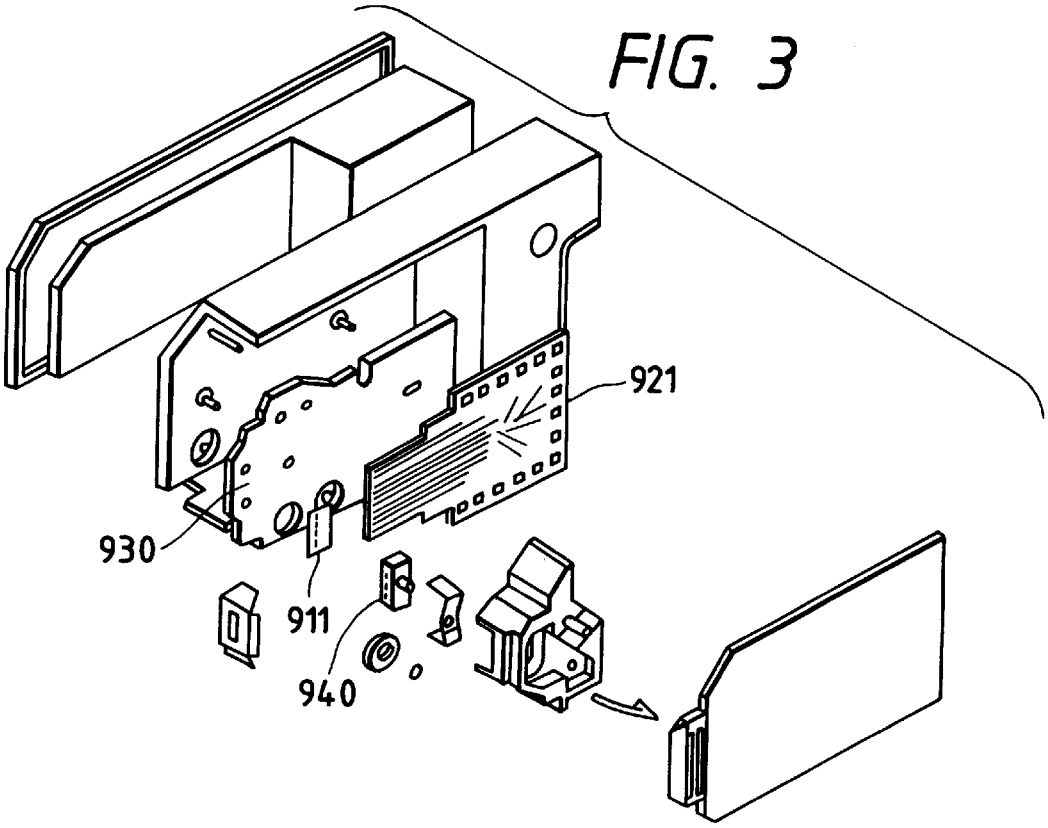
FIG. 3 is an exploded perspective view of the head cartridge shown in FIG. 1.

FIG. 2 is an external perspective view of the head cartridge 9 shown in FIG. 1, and FIG. 3 is an exploded perspective view of said head cartridge 9.

The present embodiment employs a disposable ink jet head cartridge capable of discharging inks of four colors, in which four units of the head cartridge shown in the exploded perspective view are connected. As shown in FIG. 2, the head cartridge 9 is constructed as a disposable unit, integrally composed of discharge units 9*a* serving as the recording heads and ink tanks 9*b* serving as the ink supply sources.

Inside the head cartridge 9, as shown in FIG. 3, there is provided a base plate 930 composed for example of an aluminum plate and serving as a heat dissipating plate, on which mounted are a wiring board 921 and a heater board 911. Said heater board 911 is provided with electrothermal converting elements (discharge heater) and wiring therefor formed for example with aluminum, both formed by film forming technologies on a silicon substrate. The wiring board 921 and the heater board 911 are mutually connected for example by wire bonding. On said heater board there is mounted a ceiling plate 940 provided with partitions and a common liquid chamber, for forming ink paths. Said ceiling plate 940 is formed with a resinous material and is integrally provided with a blade portion.

Figure 4:
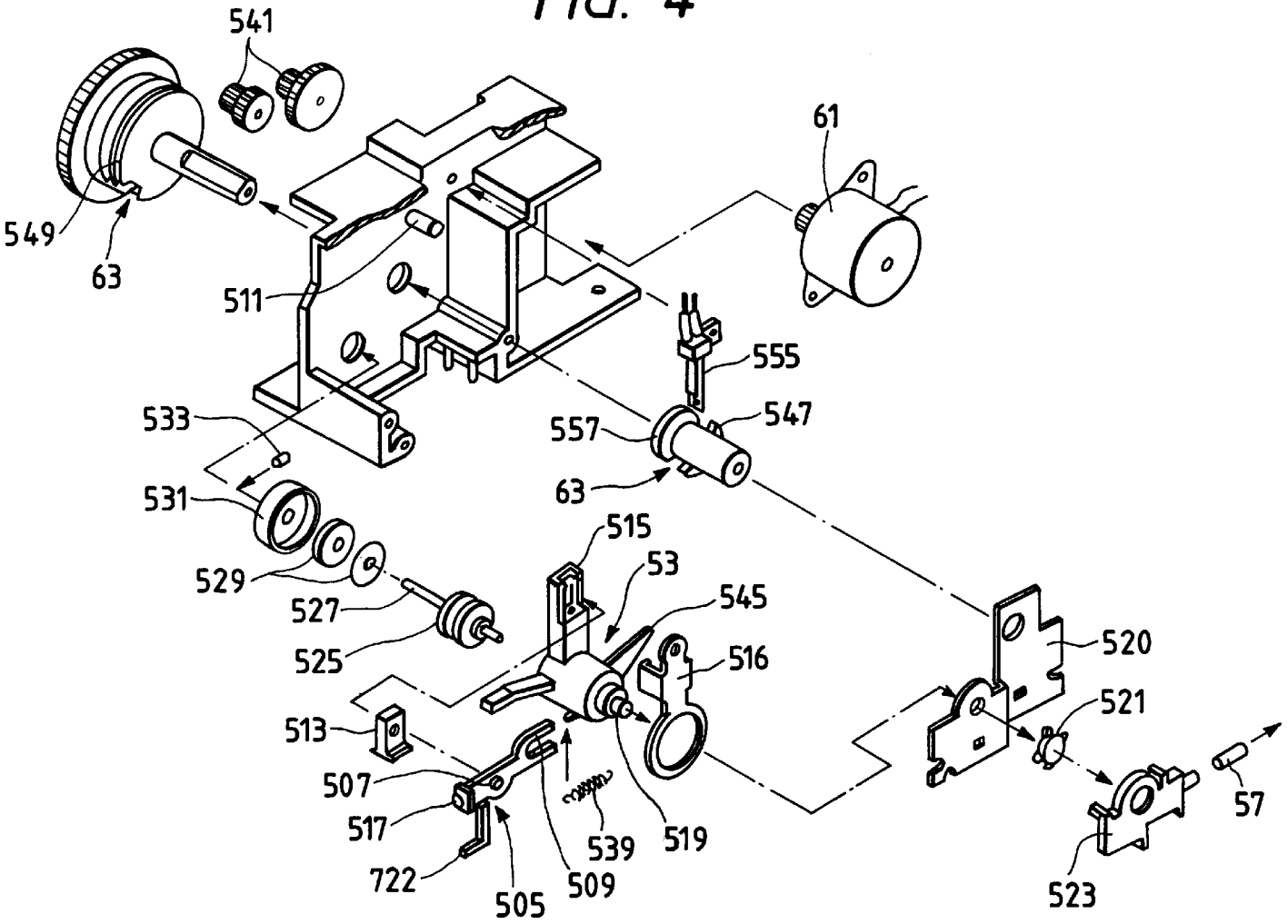
FIG. 4 is an exploded perspective view of a discharge recovery device, composed of a pump, a motor, a cam device etc., shown in FIG. 1.

FIG. 4 is an exploded perspective view of the discharge recovery device, composed of the pump 53, pump 61, cam device 63 etc. shown in FIG. 1.

A cap lever 505 shown in FIG. 4 is mounted rotatably about a pin 507, and serves to contact or disengage the blade-integrated cap 51 with or from the opening-bearing face of the recording head, by the force applied to the pin 507. An end portion 509 of said cap lever 505 engages with a pin 511, which limits the rotating range of the cap lever 505. The cap lever 505 is further provided with an integral guide rod 722 to be explained later.

For mounting the cap lever 505 on a support portion 515 provided on the pump 53, there is employed a jig 513 provided with a hole for receiving the pin 507 of the cap lever 505, and said jig 513 is securely mounted by a clamp member 516. The cap lever 505 is further provided with an action portion 517, for engaging with the approximate center of the rear side of the blade-integrated cap 51, thereby bringing said cap into contact with the opening-bearing face of the recording head. Said action portion 517 is provided with a projection, for opening a valve, provided at the back of the cap portion of the blade-integrated cap as will be explained later. Said projection is provided with an ink inlet 517A for receiving the sucked ink. Inside the cap lever 505, pin 507, jig 513 and support portion 515 there are respectively formed ink paths. When the sucking force is applied by the pump 53, the ink is introduced into the pump 53 through said paths as indicated by arrows in FIG. 4.

At the center of an end face of the pump 53 there protrudes a shaft 519 which is supported by a pump supporting plate 520, whereby the pump 53 itself is rendered rotatable, and the rotating force thereof is applied through the support portion 515 to the cap lever 505, thereby advancing or retracting the blade-integrated cap 51, which is biased by a spring 539 toward the recording head. On the shaft 519 of the pump 53, there is mounted, by a used ink cap 523, a used ink seal 521 which perpendicularly bends the ink path from the pump 53. Said used ink cap 523 forms an ink path for guiding the ink from the used ink seal 521 to the tube 57. Thus the ink sucked by the pump 53 is introduced into a used ink tank 55 (cf. FIG. 1) through said ink paths and said tube 57, as indicated by arrows in the drawing.

Inside the pump 53 there is fitted a piston 525, of which shaft 527 is provided with a packing 529 and a cap 531 in this order. The piston shaft 527, bearing the cap 531, is further provided with a pin 533 for receiving the force for driving the piston 525 from the cam device 63.

The rotation of the motor 61 is transmitted, through a gear train 541, to the cam device 63, which is provided with a cam 547 for rotating the pump 53 by engagement with an engaging portion 545 provided thereon, thereby moving the blade-integrated cap, a cam 533 for engaging with and rotating a cam 549 for engaging with the pin 533 provided on the piston shaft 527 of the pump 53 thereby activating said pump 53, and a cam 557 engaging with a switch 555 for detecting the home position of the cam device 63. The functions of these cams will be explained later.

Figure 5B:
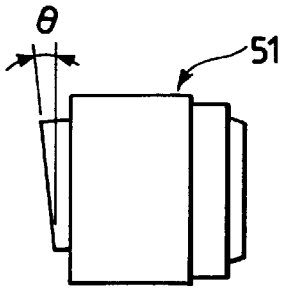
FIGS. 5A to 5D are views showing the structure of a cap portion of a blade-integrated cap shown in FIG. 1.
Figure 5A:
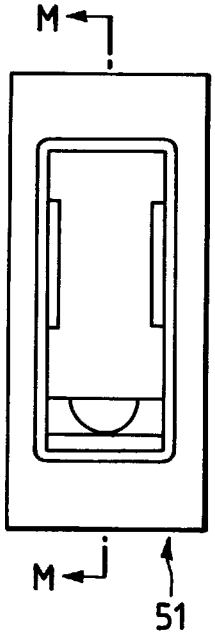
Figure 5C:
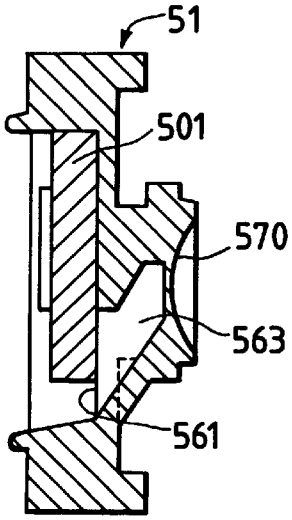
Figure 5D:
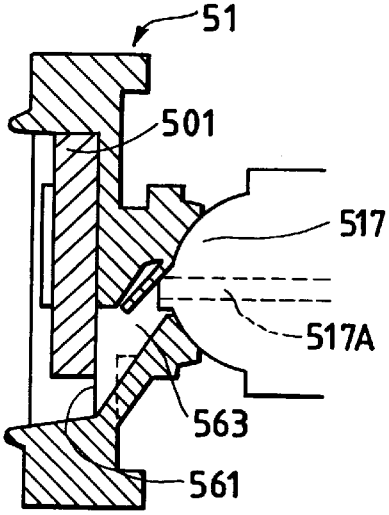

FIGS. 5A to 5D are views showing the structure of the cap portion of the blade-integrated cap shown in FIG. 1, wherein FIG. 5A is an elevation view of the cap, FIG. 5B is a plan view of the cap, FIG. 5C is a cross-sectional view of the cap along a line M—M in FIG. 5A, and FIG. 5D is a cross-sectional view along a line M—M when the action portion 517 engages with the approximate center of the rear side of the cap shown in FIG. 5A. In these drawings, the blade portion is omitted.

As shown in FIGS. 5A to 5D, the blade-integrated cap 51 is opened, in the lower internal portion thereof, to form an ink suction aperture 561, which is continued as an ink path 563 toward an ink receiving aperture 517A formed on the action portion 517 of the cap lever 505, as shown in FIG. 5D. Also inside the cap 52 there is provided an absorbent member 501, so as not to completely cover the suction aperture 561. Thus, the ink flowing downwards by gravity from the absorbent member 501 is sucked into the suction aperture 561, so that the ink amount remaining in the absorbent member 501 becomes very small. Such structure of the cap 51 of the present invention significantly delays the deterioration of the ink absorbent member by solidification of ink and of the blade-integrated cap 51 bearing said absorbent member, thereby extending the service life thereof.

The ink path 563 is provided with a valve 570, which can be opened by a projection in the action portion 517 of the cap lever 505 as shown in FIG. 5D, whereby said ink path 563 in the cap 51 communicates with the ink path in said cap lever 517. Thus the interior of the cap, when covering the discharge port-bearing face of the recording head, is sealed from the external atmosphere except during the suction operation for the discharge recovery operation and can therefore prevent drying of the ink in the discharge ports of the recording head.

Figure 6:
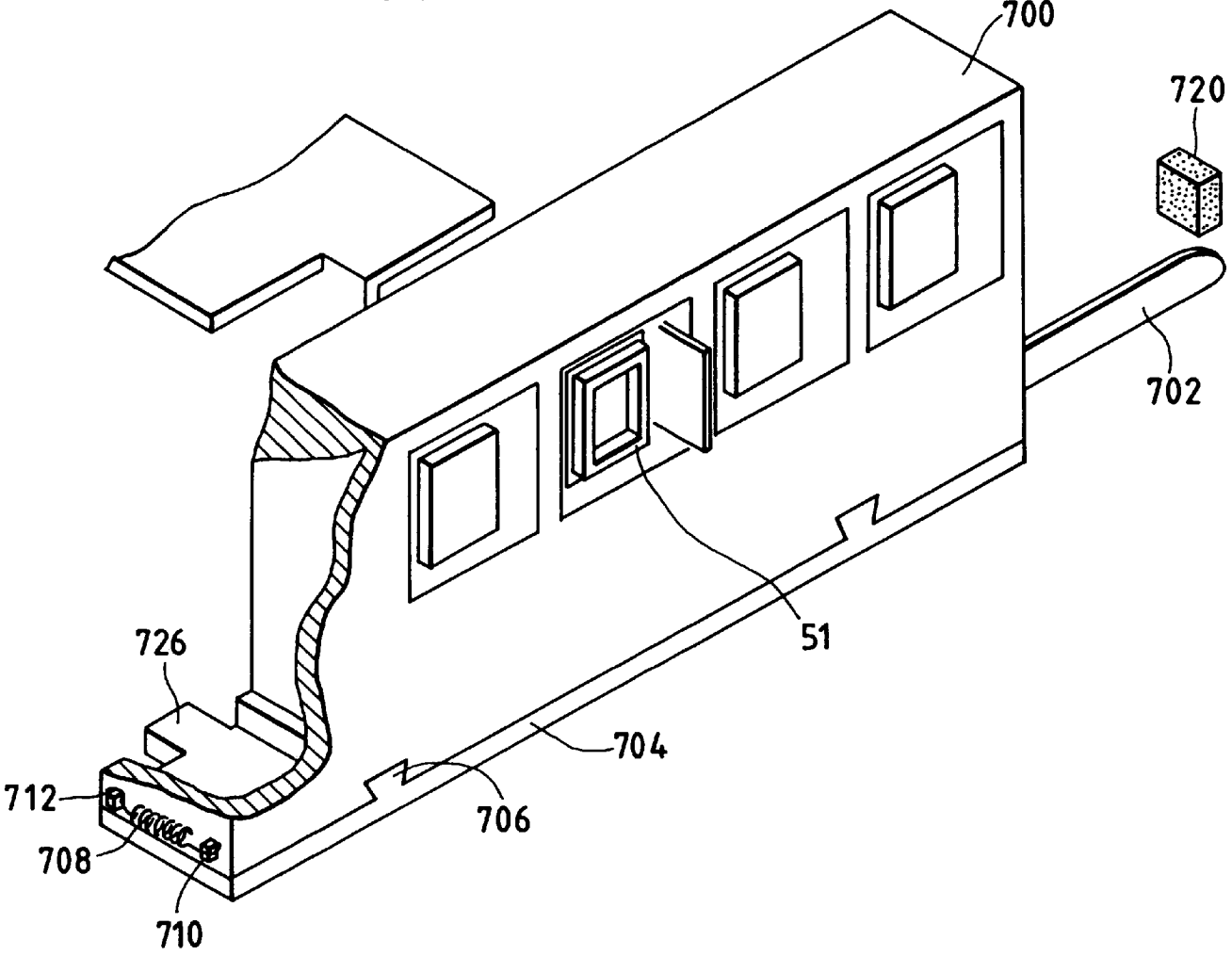
FIG. 6 is a schematic perspective view of a cap unit, composed a cap, a connecting frame etc., shown in FIG. 1.

FIG. 6 is a schematic view of the cap unit, composed of the cap 51, connecting frame 700 etc. shown in FIG. 1.

As the recording apparatus of the present embodiment can record with inks of four colors, there are provided four blade-integrated caps assigned respectively for the four colors. On the other hand, in the present embodiment, there are provided only one suction pump and one cam device for contacting or separating the blade-integrated cap with or from the recording head, regardless of the number of colors of the inks, and such suction pump and cam device are rendered selectively engageable with one of the four blade-integrated caps, depending on the carrier position.

As shown in FIG. 6, the blade-integrated caps 51 are supported by the connecting frame 700, which is rendered movable in the carrier scanning direction, by means of a base 704 and a guide groove 702. The connecting frame 700 engages, at the lower face thereof, with the base 704 and is rendered slidable, by a sliding mechanism 706, in a direction perpendicular to the carrier scanning direction. The connecting frame 700 and the base 704 are respectively provided, on a same lateral face, with fingers 710, 712 supporting the ends of a tension spring 708, which exerts a biasing force to maintain the connecting frame and the base in the position shown in FIG. 6 when the connecting frame 700 is not subjected to the external force.

Figure 7:
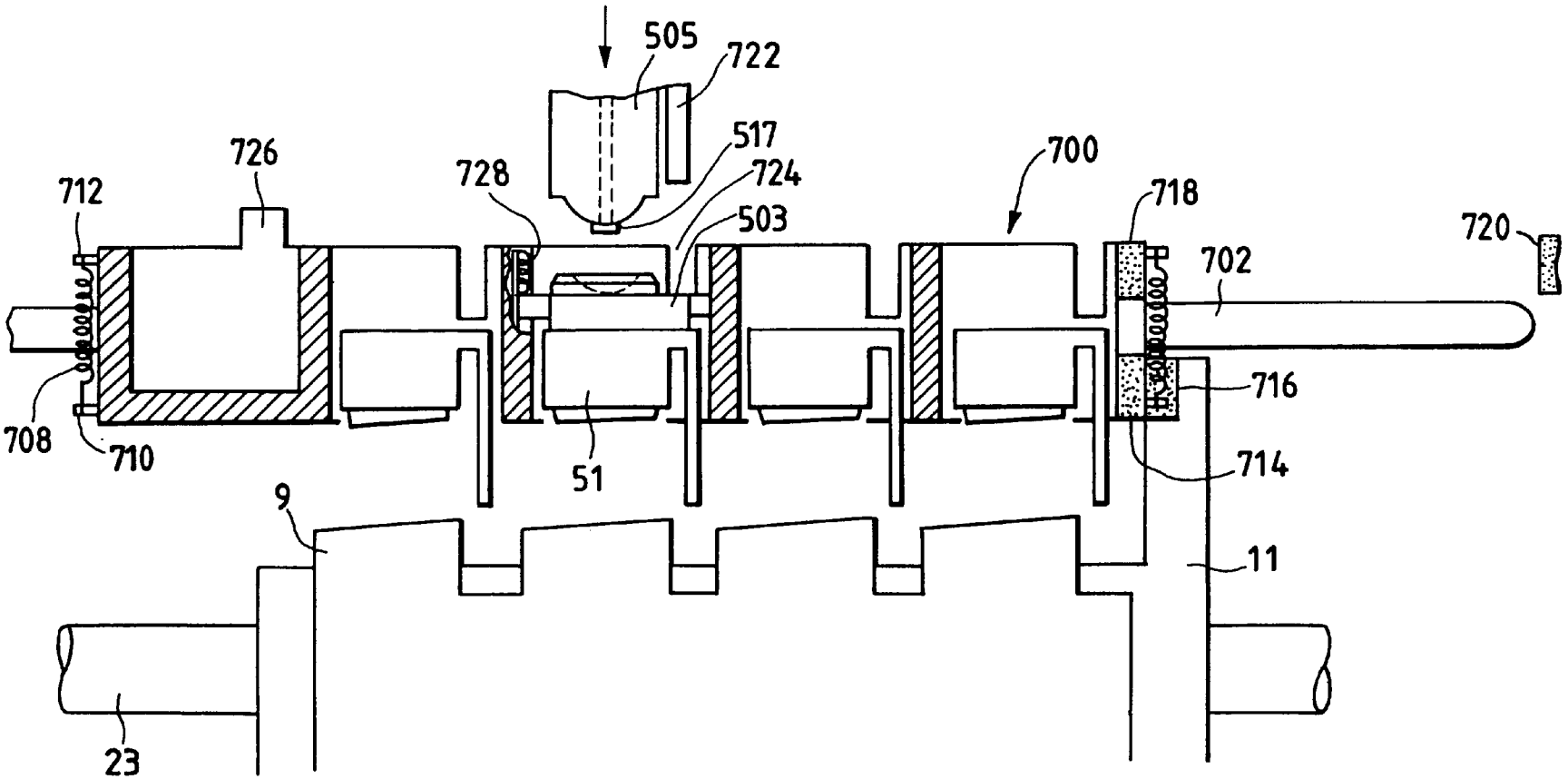
FIG. 7 is a plan view showing the relationship between the cap unit shown in FIG. 6 and the head cartridge.

FIG. 7 is a plan view showing the positional relationship between the cap unit shown in FIG. 6 and the head cartridge.

As shown in FIG. 7, the head cartridge 9 is mounted on the carrier 11 effecting the scanning motion along the guide shaft 23, and the connecting frame 700 is provided movably in the scanning direction along the guide groove 702, in a position opposed to the head cartridge 9. An end portion of the carrier 11 extends toward the connecting frame 700 so as to hinder the movement thereof, and said end portion and a lateral end of the base 704 are respectively provided with ferrite magnets 714, 716 in order to define the relative position between the recording head on the carrier and the blade-integrated cap in the connecting frame and to enable linked movement of the connecting frame and the carrier, within the movable range of said connecting frame in the carrier scanning direction.

In a predetermined position in the scanning direction of the connecting frame 700, there is provided a ferrite magnet 720 as a stopper for fixing said connecting frame at the recording operation, and the base 704 is provided with another ferrite magnet 718 for coupling with the above-mentioned ferrite magnet 720. The ferrite magnets 714, 718 are provided at respectively different heights in FIG. 7.

A guide rod 722, provided under the cap lever 505, is linked with said cap lever, and engages a groove 724 formed on the connecting frame at the capping operation, thereby inhibiting the movement of the blade-integrated cap in the carrier scanning direction and avoiding positional aberration between the cap lever 505 and the blade-integrated cap 51 in the carrier scanning direction at the capping operation. In FIG. 7, all the blade-integrated caps are illustrated in the retracted position, and the capping or wiping operation can be achieved by advancing the cap lever with a controlled amount, as indicated by an arrow.

A cap holder 503, supporting the cap 51, is provided with a tension spring 708 for elastically connecting the cap holder 503 with the connecting frame 700 and returning the cap to the illustrated retracted position. The biasing forces of said tension spring 708 and of the tension spring 728 maintained between the base 704 and the connecting frame 700 are selected weaker than the biasing force of the cap lever by the aforementioned spring 539 (cf. FIG. 4).

The connecting frame 700 is provided with a projection 726, which, when pushed by said guide rod 722, moves the entire connecting frame toward the recording heads, thereby capping all the recording heads. It is thus rendered possible to prevent dust deposition on or ink drying in the recording heads when the recording operation is not conducted.

In the present embodiment, a blade-integrated cap is provided for each ink color, but such configuration is not limitative. For example, if detrimental effect is not generated by the mixing of inks of similar colors, a same blade-integrated cap may be employed for these colors, and a compacter recording apparatus can be obtained in this manner.

In the following there will be explained the functions of the discharge recovery device of the present embodiment.

Figure 8:
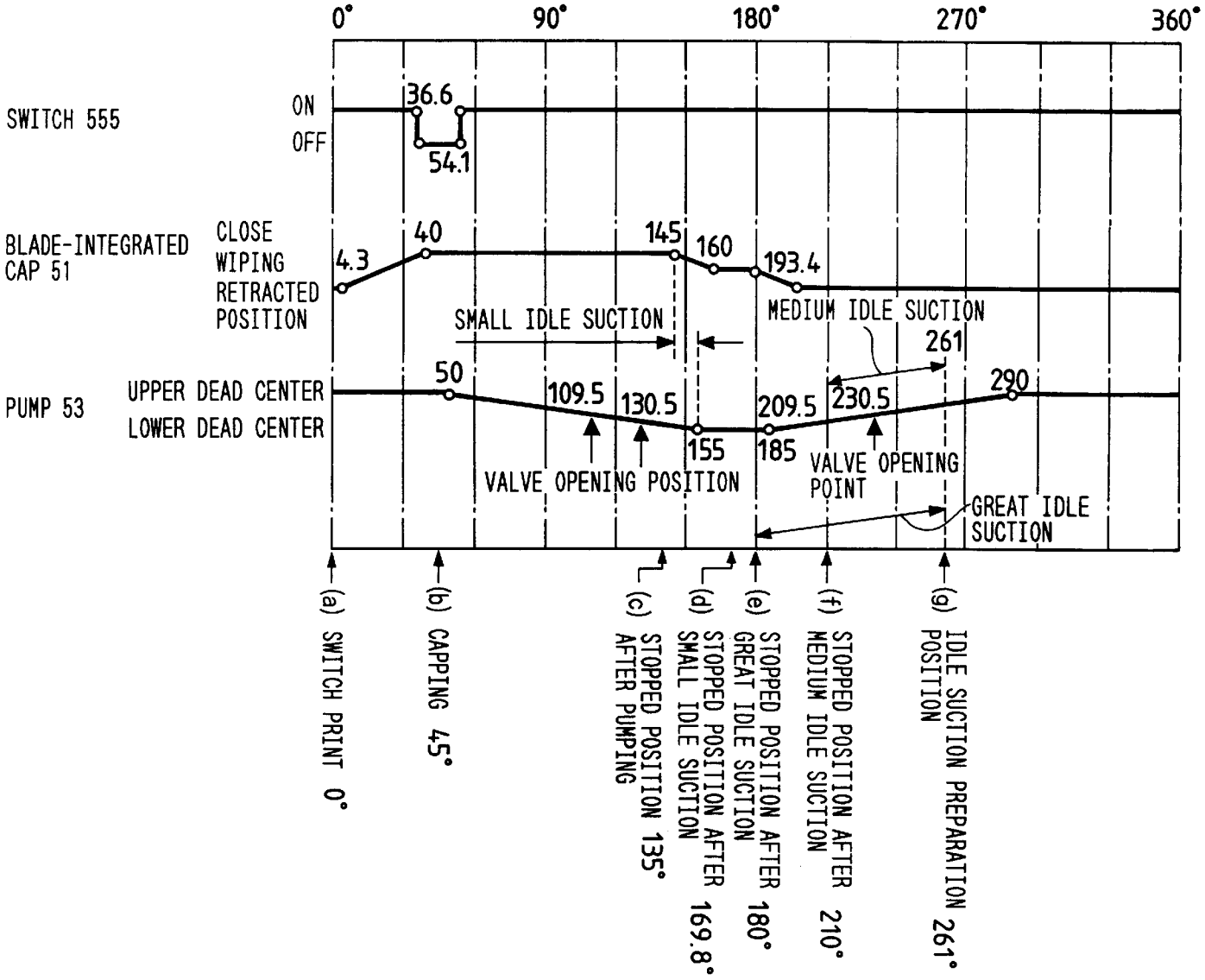
FIG. 8 is a cam chart of the discharge recovery device provided in the first embodiment of the ink jet recording apparatus of the present invention, showing the state of a switch, a blade-integrated cap and a pump as a function of rotation angle of the cam, shown in FIG. 4, in the abscissa.
Figures 1, 9:
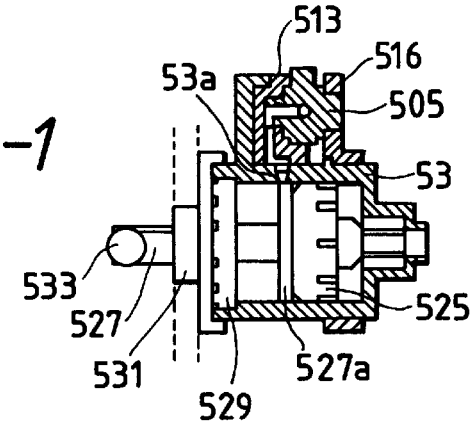
Figures 2, 9:
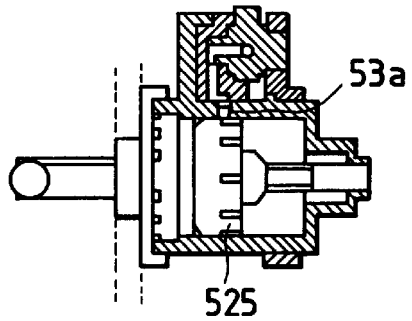
Figures 3, 9:
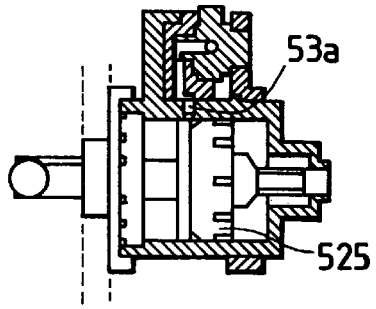
Figures 4, 9:
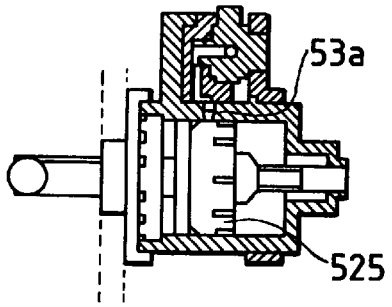
Figures 5, 9:
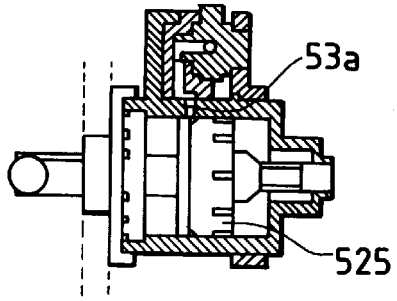

FIG. 8 is a cam chart of the discharge recovery device provided in the first embodiment of the ink jet recording apparatus of the present invention, showing the states of the switch 55, blade-integrated caps 51 and pump 53 as a function of the rotation angle, in the abscissa, of the cam 549 shown in FIG. 4. Also FIGS. 9-1 to 9-5 illustrate the positions of the piston 525 in the pump 53, corresponding to the various states shown in the cam chart in FIG. 8.

Referring to FIG. 8, (a) indicates a home position of the cam 549, namely the stand-by state of the discharge recovery device during the printing operation. In this state, the switch 555 is turned on, while the blade-integrated caps 51 are retracted from the opening-bearing faces of the recording heads, and the pump 53 is at an upper dead point.

A state (b) indicates the capping state, in which the opening-bearing faces of the recording heads are covered and protected, for example when the recording apparatus is not in use. In this state, the switch 555 is turned off, while the blade-integrated caps 51 are maintained in contact with the opening-bearing faces of the recording heads, and the pump 53 is at the upper dead point.

A state (c) indicates a state after the completion of pumping, in which the switch 555 is turned on, while the blade-integrated caps 51 are maintained in contact with the opening-bearing faces of the recording heads, and the pump 53 is with the fully-opened valve but has not reached the lower dead point.

A state (d) is after the separation of the blade-integrated caps 51 following the pumping operation and after a small idle suction for inhaling the ink, present in the cap portions of the blade-integrated caps 51 and in the cap lever 505, into the pump 53. In this state the switch 555 is turned on, while the blade-integrated caps 51 are in a position somewhat moved in the retracting direction, and the pump 53 is at the lower dead point. Also in this state, the opening-bearing face is wiped by the movement of the carrier.

In the following there will be explained a state (g), which is a preparatory position for initiating the idle suction for discharging the ink, present in the pump 53 by the pumping operation, into the used ink tank. In this state the switch 555 is turned on, while the blade-integrated caps are in the retracted position, and the pump 53 is in a position slightly down from the upper dead point.

States (e) and (f) are stop positions respectively after great and medium idle suctions. In both states the switch 555 is turned on, and the blade-integrated caps are in the retracted position. The pump 53 is at the lower dead point in the state (e), but has not been lowered completely in the state (f).

FIG. 9-1 illustrates a state in which the piston 525 of the pump is at the lower dead point. The pumping action is exerted by a negative pressure, generated in the space at the left side of the piston 525. The pump 53 is provided with a valve aperture 53*a* for transmitting said negative pressure to the cap portion of the blade-integrated cap 51 through the cap lever 505. In FIG. 9-1, the piston 525 has advanced to the right, beyond the valve aperture 53*a*. In this state the piston 525 is pressed, from the left side, by a flange portion 527*a* of the piston shaft 527, whereby the generated negative pressure is transmitted, without leakage, to the blade-integrated cap 51. Also the ink, present at the right side of the piston 525 is pushed out toward the used ink tank.

FIG. 9-2 indicates a state at the upper dead point. It is to be noted, in this state, that the piston 525 is positioned at the left side of the valve aperture 53*a* so that said valve aperture 53*a* is not closed. Thus, in this state, the blade-integrated cap 51 is in communication with the external air.

FIG. 9-3 corresponds to the state (c) in FIG. 8, in which the piston 525 has moved to the right, slightly beyond the valve aperture 53*a*.

FIG. 9-4 corresponds to the state (g) in FIG. 8, and the great or medium idle suction is achieved by the shift between this state and a state of FIG. 9-1 or 9-5.

FIG. 9-5 indicates a state after the execution of the medium idle suction. It is to be noted that the piston 525 is stopped immediately after passing the valve aperture 53*a*. If the piston has moved to the lower dead point in the state of FIG. 9-1, there will result a long period in which the valve aperture 53*a* is not closed, in the returning stroke to the upper dead point in the state of FIG. 9-2 or to the idle suction preparatory position in the state of FIG. 9-4. In order to avoid generation of a positive pressure in the left-side space, there is designed a certain gap between the flange 527*a* of the piston shaft 527 and the piston 525, said gap being in communication with the space at the right side of the piston 525. Nevertheless there will result a certain positive pressure, for example because of the resistance in the ink path, thus inducing a reverse flow. However, such reverse flow is securely prevented in case of the returning stroke from the position in FIG. 9-5 to the position in FIG. 9-1 or 9-4.

Figure 10:
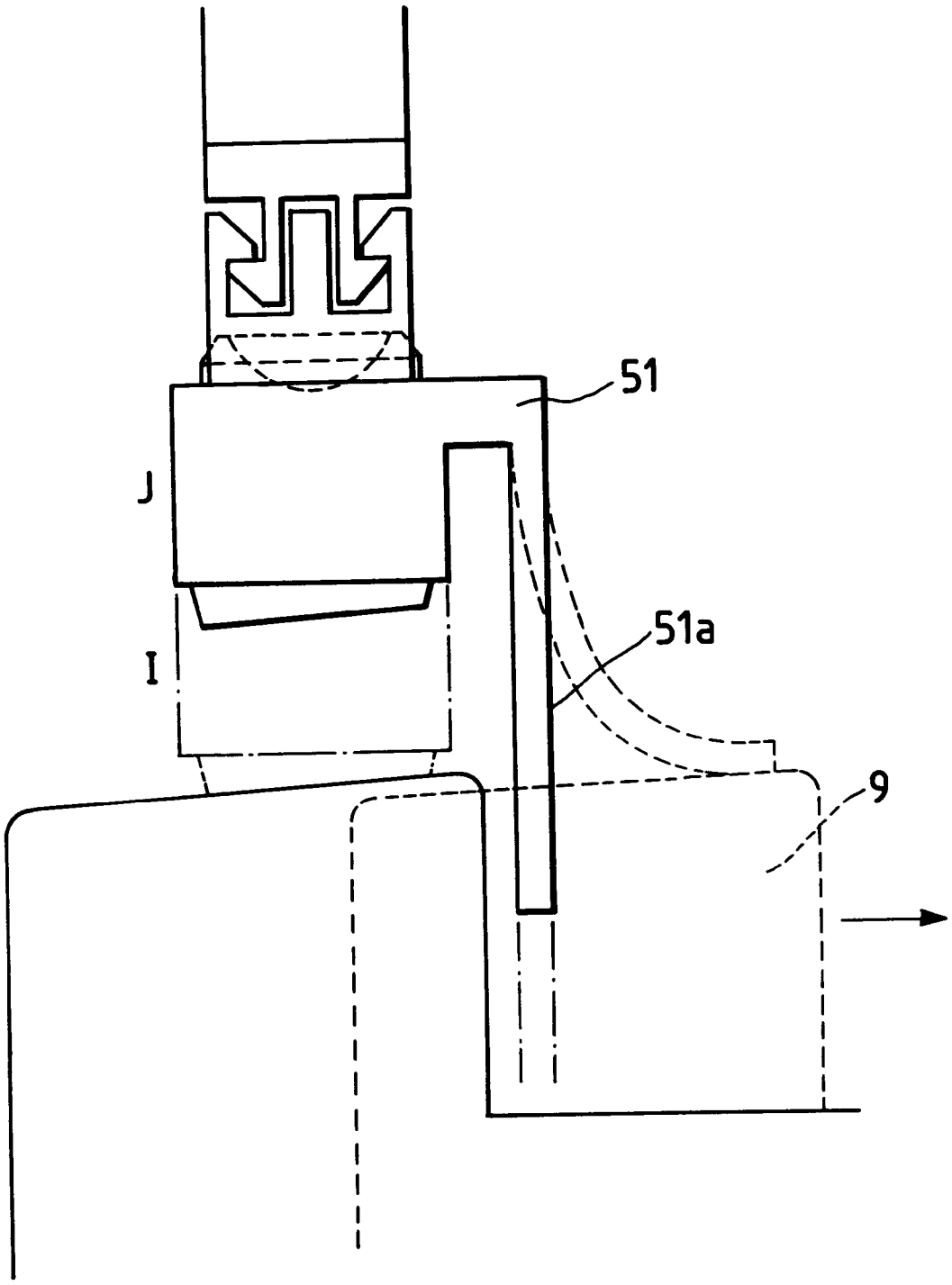
FIG. 10 is a view showing the relationship between the head cartridge shown in FIG. 1 and the cap in the scanning operation.

FIG. 10 is a view showing the positional relationship of the head cartridge 9, shown in FIG. 1, with respect to the cap 51 in the scanning motion.

For effecting the capping operation for the discharge recovery operation, such as by suction, the blade-integrated cap 51 is once withdrawn to an unrepresented retracted position and the head cartridge 9 is moved to a position (home position) where the opening-bearing face thereof is opposed to the cap 51, as shown in FIG. 10. Subsequently the blade-integrated cap 51 is brought into a state I, indicated by chain lines, in contact with the head cartridge 9.

For effecting the wiping operation, the head cartridge 9 is moved to the home position during the printing operation in which the blade-integrated cap is in the retracted position, and the blade-integrated cap 51 is then moved to a broken-lined position J (wiping position). Subsequently the wiping operation is executed by the movement of the head cartridge 9 in a direction indicated by an arrow, until an unrepresented position where it is no longer in contact with the blade 51*a*.

On the other hand, when the wiping operation is conducted from the capped state, the blade-integrated cap is retracted only to the wiping position, and the carrier is then moved.

Figure 11:
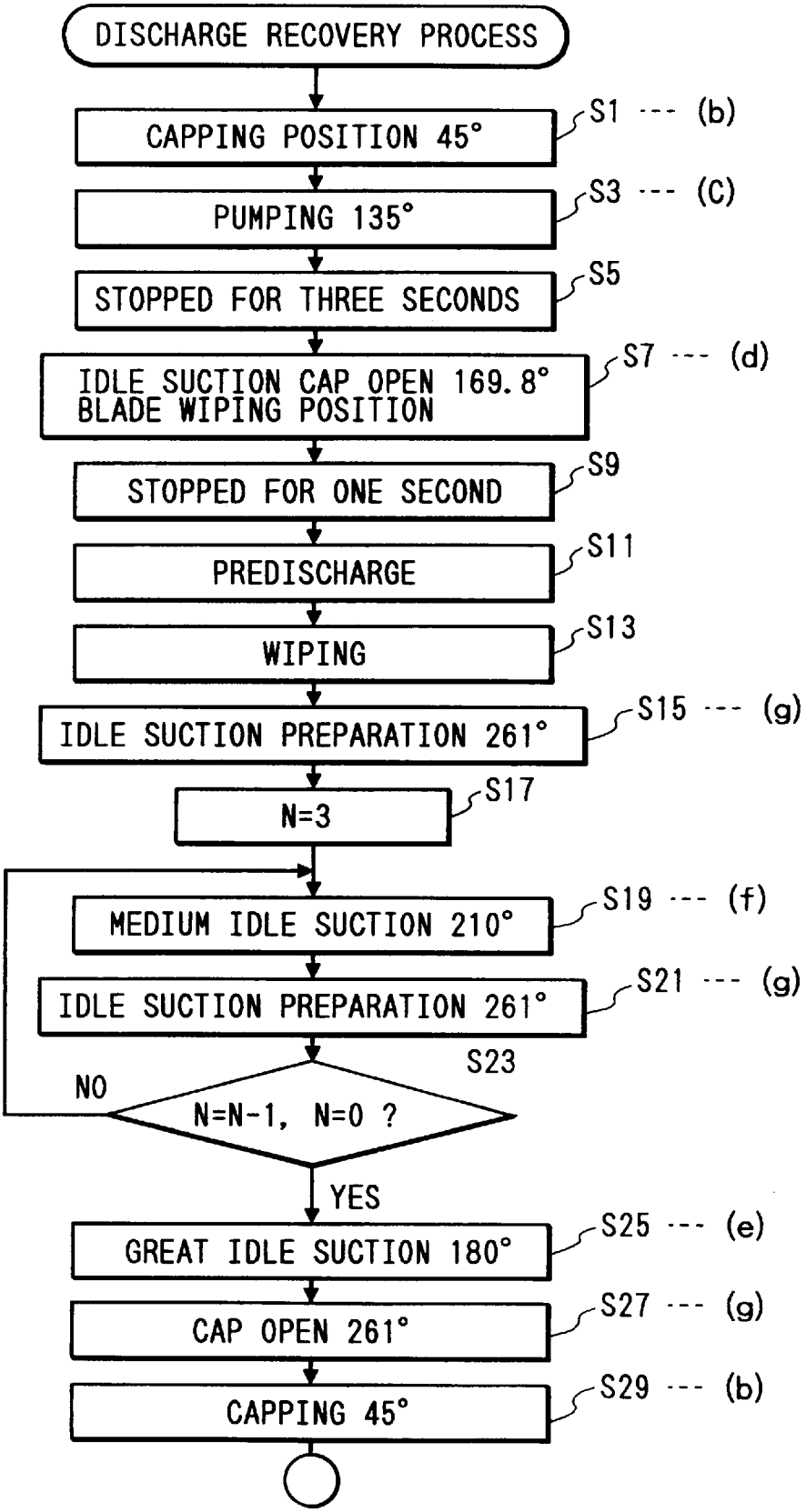
FIG. 11 is a flow chart showing the discharge recovery operations for the recording head, to be executed by the discharge recovery device equipped in the first embodiment of the ink jet recording apparatus of the present invention.

FIG. 11 is a flow chart showing the discharge recovery operation for the recording head, to be executed by the discharge recovery device equipped in the first embodiment of the ink jet recording apparatus of the present invention.

The flow starts from the capped state (b) in FIG. 8 (step S1). The pumping operation is executed by the shift to the state (c) (step S3), and this state is retained for 3 seconds for achieving sufficient ink suction (step S5). Then the state (d) is so executed that the blade-integrated cap stops at the wiping position for 1 second, and small idle suction is executed at the same time (steps S7, S9), whereby the ink present in the blade-integrated cap 51 and the cap lever 505 is inhaled. Subsequently the predischarge operation is conducted (step S11), and then the wiping operation is conducted by the movement of the head cartridge to a position where it is no longer in contact with the blade (step S13). Then the blade-integrated cap is moved to the retracted position, and idle suction is conducted for discharging the ink present in the pump 53. At first there is conducted the shift to the idle suction preparatory position (g) (step S21), and, from this position, there are repeated three cycles of shifts to the medium idle suction stop position (f) (steps S17–S23). Subsequently there is conducted the great idle suction from (e) to (g) in FIG. 8 (steps S25, S27), whereby the ink in the pump 53 is sufficiently pushed out toward the used ink tank. Finally the carrier is returned to the capping position, and the capping is executed as in (b) (step S29).

Figure 12:
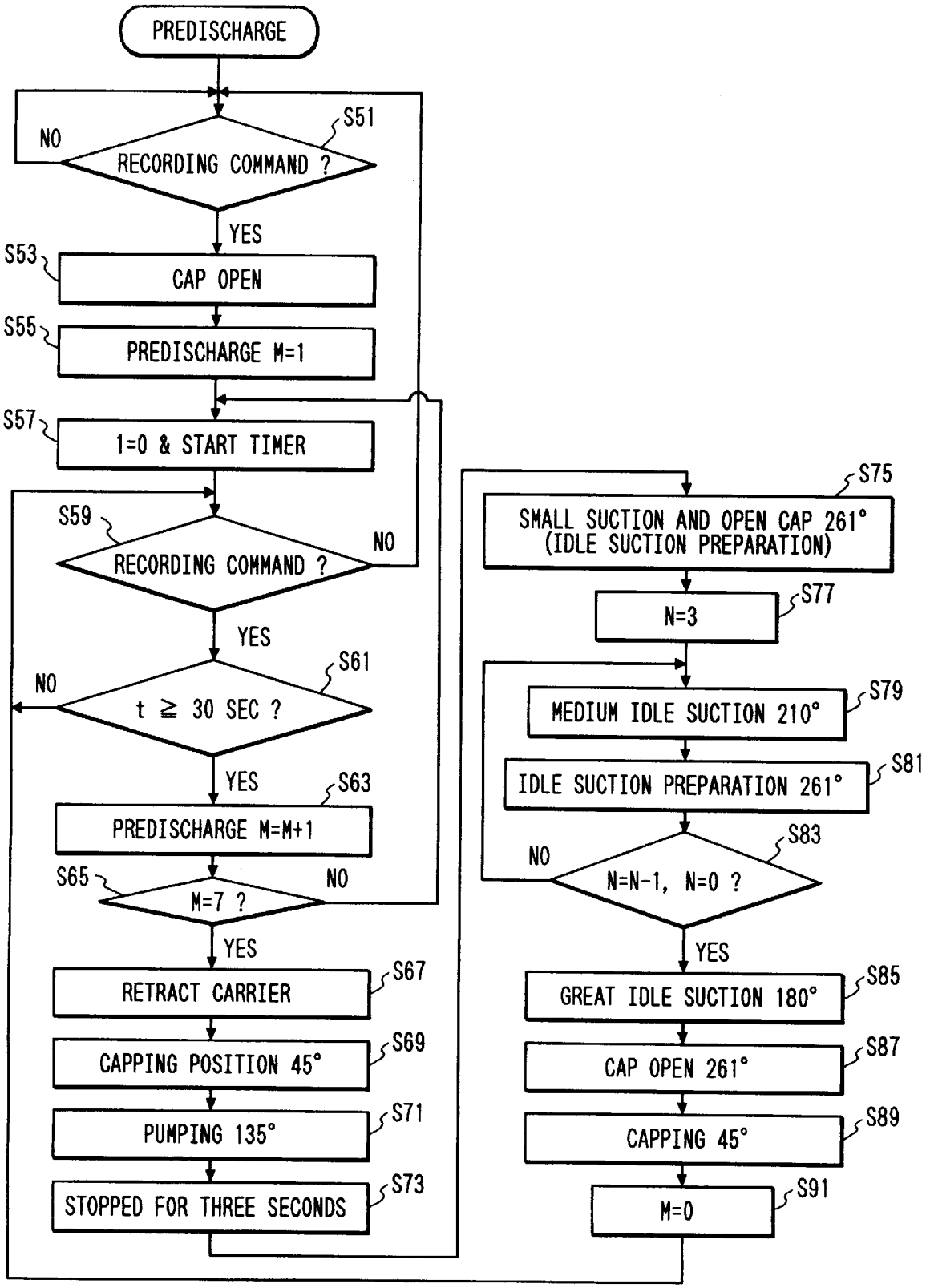
FIG. 12 is a flow chart showing the flow of predischarge and reception of the ink, received in the cap by said predischarge, into the used ink tank, in the course of recording operation in the first embodiment of the ink jet recording apparatus of the present invention.

FIG. 12 is a flow chart showing the flow of the predischarge during the recording operation and the reception of the ink, received in the cap by said predischarge, into the used ink tank, in the first embodiment of the ink jet recording apparatus of the present invention.

At first, in response to a recording command, the cap is separated (step S53) and the predischarge is conducted (step S55). Then started is the counting operation of a timer (step S57), and the predischarge is conducted every 30 seconds (steps S59, S61). At every seven cumulative predischarges (steps S63, S65), there is executed an operation similar to the above-explained discharge recovery operation, with the recording head displaced from the cap, whereby the unnecessary ink, accumulated in the cap by the predischarges, is discharged by suction (steps S67–S91).

Figure 13:
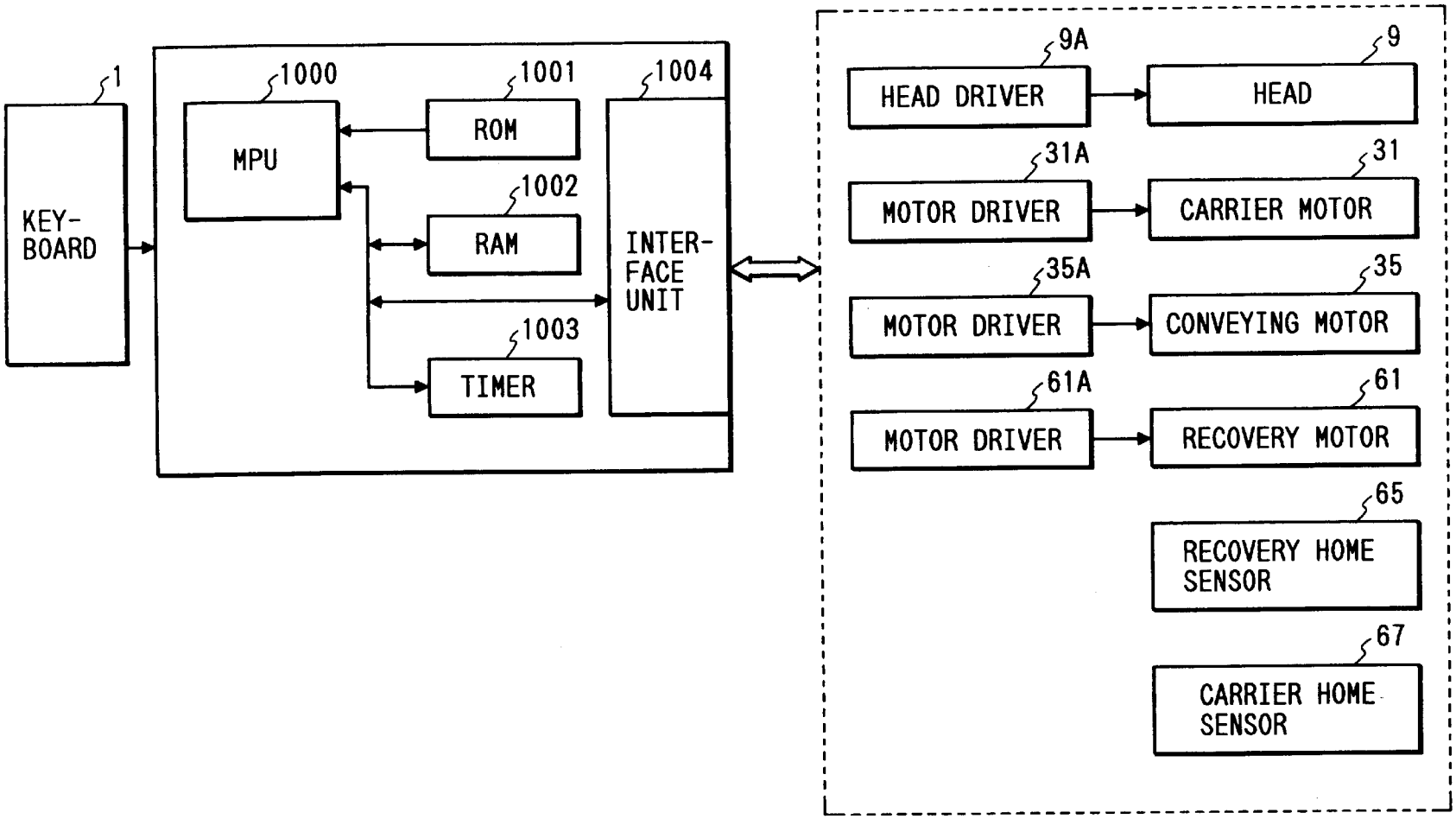
FIG. 13 is a block diagram showing the control system of the first embodiment of the ink jet recording apparatus of the present invention.

FIG. 13 is a block diagram of the control system in the first embodiment of the ink jet recording apparatus of the present invention.

The capping position and the moving position of the carrier 11 can be known, utilizing the detections by a recovery home sensor 65 and a carrier home sensor 37. In FIG. 13 there are shown an MPU 1000 for controlling various units according to a predetermined control sequence; a ROM 1001 storing programs corresponding to said control sequence; a RAM 1002 used as a work area in the execution of said control sequence; a timer 1003 for effecting time measurement required in the control; and an interface unit 1004. Instructions and data can be entered into the control system from a keyboard.

[2nd embodiment]

Figure 14:
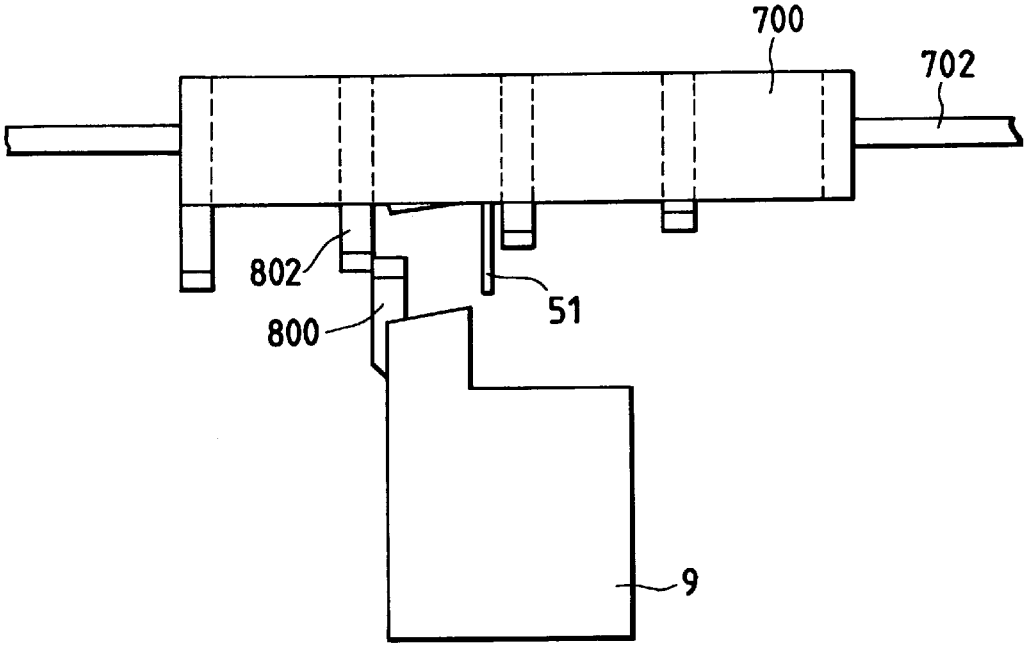
FIG. 14 is a view showing the positional relationship between a monochromatic recording head, provided with an identification mark indicating the kind of ink, an the discharge recovery device, in a second embodiment of the ink jet recording apparatus of the present invention.

The first embodiment explained above employs a head cartridge capable of discharging inks of four colors, but such configuration is not limitative. For example, in a monochromatic recording apparatus accepting a head cartridge of one color only, as shown in FIG. 14, the head cartridge 9 may be provided with a projection 800, having a length corresponding to each color and thus serving as a color identifying device, while the connecting frame 700 may be provided with projections 802, capable of engaging with said projection 800 and having mutually different lengths for respective caps, whereby a cap, corresponding to the ink color of the head cartridge loaded on the recording apparatus, can be automatically selected. The projections 800, 802 are provided, at the end portions thereof, with ferrite magnets as in the foregoing 1st embodiment.

[3rd embodiment]

Figure 15:
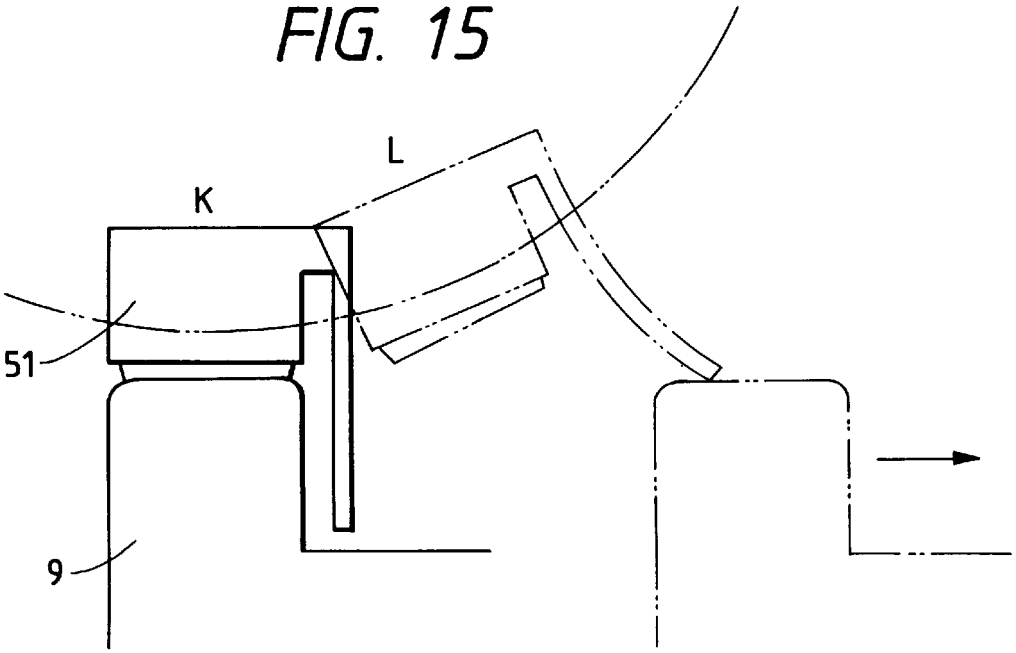
FIG. 15 is a view showing the positional relationship between a head cartridge and the discharge recovery device, a third embodiment of the ink jet recording apparatus of the present invention.

FIG. 15 shows an embodiment in which the movement of the blade-integrated cap is effected not by a linear motion but by a rotary motion. The blade-integrated cap effects the capping in a position K, by clockwise rotation from an unrepresented retracted position. Also the wiping operation is achieved by the movement of the carrier in a direction indicated by an arrow, at a wiping position L between the retracted position and the capping position. The above-mentioned rotary motion of the blade-integrated cap is achieved by controlling the movement of the aforementioned cap lever 505 (cf. FIG. 4), by means of a rack gear provided on the carrier, a flat gear provided, so as to engage with or disengage from said rack gear, in the discharge recovery device, and a cam device linked with said flat gear.

[4th embodiment]

Figure 16A:
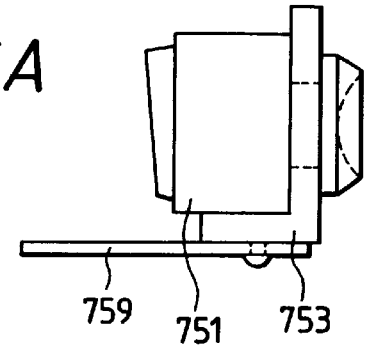
FIGS. 16A and 16B are external views of a fourth embodiment of the ink jet recording apparatus of the present invention, in which the cap and the blade are composed of separate members.
Figure 16B:
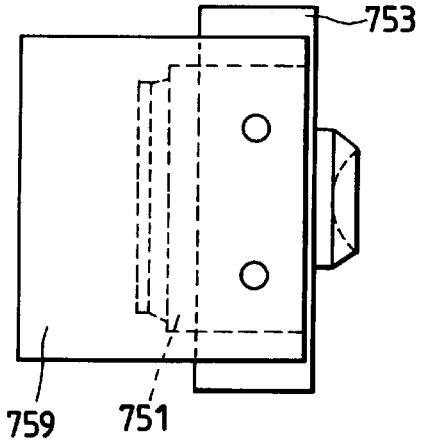

FIGS. 16A and 16B show an embodiment in which the blade 759 and the cap 751 are formed as separate members and are mutually connected by a holder 753. In this embodiment the cap is composed of chlorinated butyl rubber while the blade is composed of urethane rubber. In this manner the cap and the blade of the present invention need not necessarily be formed as an integral member of a same material.

[5th embodiment]

Figure 17:
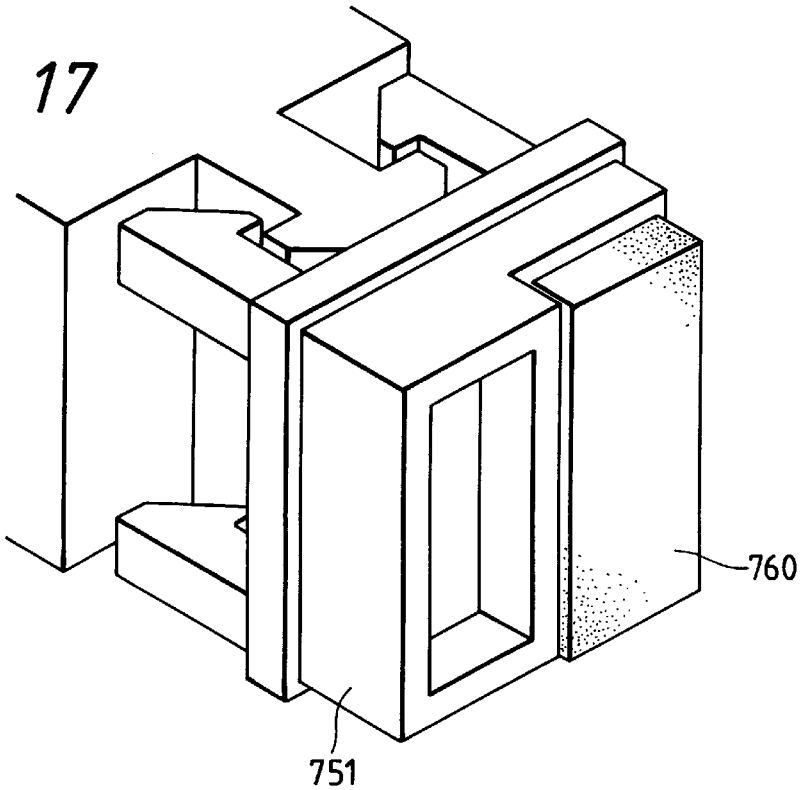
FIG. 17 is an external perspective view of a fifth embodiment of the ink jet recording apparatus of the present invention, wherein the cap and the absorbent member are integrated.

FIG. 17 shows an embodiment in which the cap 751 and the absorbent member 760, composed of a porous material, are constructed integrally. Said absorbent member is to be maintained in contact with the discharge port-bearing face of the recording head, in order to eliminate, by absorption, the unnecessary ink deposited on said face. In this manner the integral structure need not be limited to the blade and the cap, but may be applied to the blade and the absorbent member.

Also it is not mandatory to form the absorbent member and the cap with different materials. For example the absorbent member may be obtained by foaming the material constituting the cap.

[6th embodiment]

The absorbent member 760 of the 5th embodiment, shown in FIG. 17, may also be used for receiving the ink, discharged in the predischarge operation. Such configuration dispenses with the idle suctions required in case of the predischarges into the cap, thereby alleviating the requirement for durability of the discharge recovery device and improving the throughput.

[7th embodiment]

In the foregoing first embodiment, the blade-integrated cap is provided with three stopping positions, namely the capping position, wiping position and retracted position, but such configuration is not limitative. For example the wiping operation may be achieved by moving the carrier while the blade-integrated cap is moved from the capping position to the retracted position, and, in this manner, the present invention can be attained with only two stopping positions, whereby the cam device can be simplified in structure and further reduction indimension can be achieved.

[8th embodiment]

In the foregoing embodiments, the cap and the blade or the absorbent member are constructed integrally, but such configuration is not limitative. For example the blade and the cap may be constructed independently, and the cap may be advanced by the aforementioned cap lever while the blade may be advanced by the aforementioned guide rod.

It is furthermore possible to fix a blade, common for all the ink colors, at a constantly protruding wiping position. In case of using a same blade for different ink colors, the color mixing by the wiping operation may be prevented, for example, by a configuration of eliminating the ink, deposited on said blade in the wiping operation, with a cleaning member such as an absorbent member provided on the carrier.

[9th embodiment]

Although the foregoing embodiments employ only one pump, there may be employed plural pumps at suitable positions, in case of utilizing a head cartridge with plural recording heads as in the 1st embodiment or in case of a recording apparatus capable of accepting plural head cartridges at the same time. In this manner it is rendered possible to reduce the time required for the suction of plural recording heads, and to alleviate the requirement for durability of the discharge recovery device.

The present embodiment is effective also in a recording apparatus capable of accepting plural heads different in the suction pressure, suction amount etc. required in the discharge recovery operation. In such case there may be provided plural pumps different in the suction pressure, suction amount etc., and a suitable pump can be selected for the recovery operation according to the required conditions.

[10th embodiment]

In the foregoing embodiments a valve is provided in the cap, but such valve may be dispensed with in case complete sealing from the external atmosphere is not required for example because of a very slow drying speed of the ink in the discharge ports or in case the discharge recovery operation is always conducted immediately before the recording operation, in response to the recording command.

Also said valve may be constructed with a separate member, with a spring of a weak returning force at the hinge, in such a manner that said valve is opened when the interior of the cap exceeds a certain pressure, in order to prevent air intrusion into the ink discharge ports, induced for example by pressure increase caused by the volatile component of the ink present in the cap.

Said valve may also be dispensed with by suppressing the air flow between the exterior and the cap, for example by designing the ink path sufficiently long.

[11th embodiment]

In the foregoing embodiments, the inks are assumed to be different in their colors, but they may also be different in the recording media, for example the inks for ordinary paper, OHP sheet, fabric etc.

[12th embodiment]

In the foregoing embodiments, the relative movement between the pump and the cap is achieved solely by the movement of the cap, but such configuration is not limitative. For example it is also possible to move the pump in relation to the movement of the carrier, or to move both the pump and the cap by coupling the pump and the connecting frame with idler gears.

In this manner the relative movement of the cap and the pump need not be achieved by the movement of either, but can be suitably selected according for example to the shape of the recording apparatus.

[13th embodiment]

The identifying device provided on the recording head need not be mechanical one as in the foregoing 2nd embodiment, but may also be provided electrically, for example by a pattern on the printed circuit board of the head cartridge. In such case the kind of ink is identified through the flexible printed circuit. In such case there may be provided an additional motor, exclusive for moving the connecting frame and linked therewith through gears, and the movement of the connecting frame may be controlled for example with a home position sensor provided in addition to those for the pump cam and the carrier.

[Other embodiments]

The foregoing description has been limited to a disposable head cartridge integrally containing recording heads and ink tanks, but the present invention is applicable also to a permanent recording head, independent from the ink tank.

Also the foregoing description has been limited to the ink jet recording apparatus utilizing the bubble (thermal) jet method, but the present invention is applicable to any ink jet recording apparatus, for example the one utilizing a recording head with an electromechanical converting element such as a piezoelectric element.

Also the configuration of the recovery device, composed of the caps, blades, absorbent members etc. is not limited to that in the foregoing embodiments. For example, there may be employed a blade for two caps.

[14th embodiment]

Figure 18:
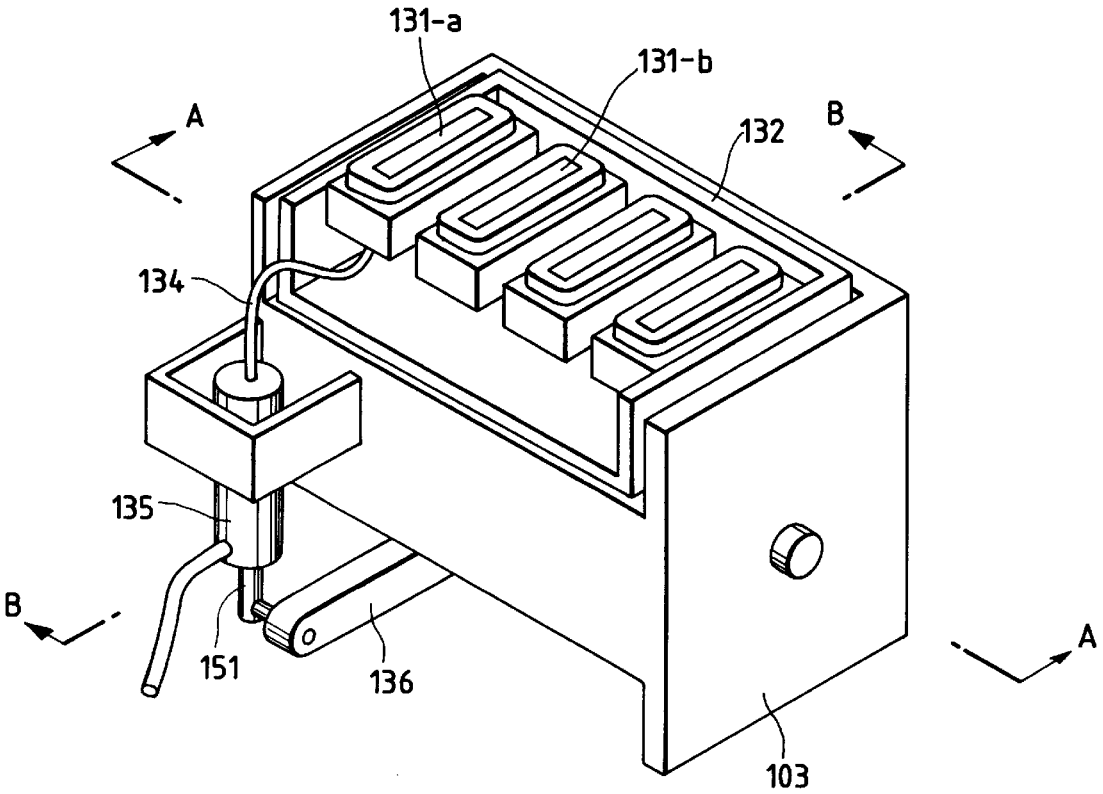
FIG. 18 is a perspective view of another embodiment of the ink jet recording apparatus of the present invention.
Figure 19:
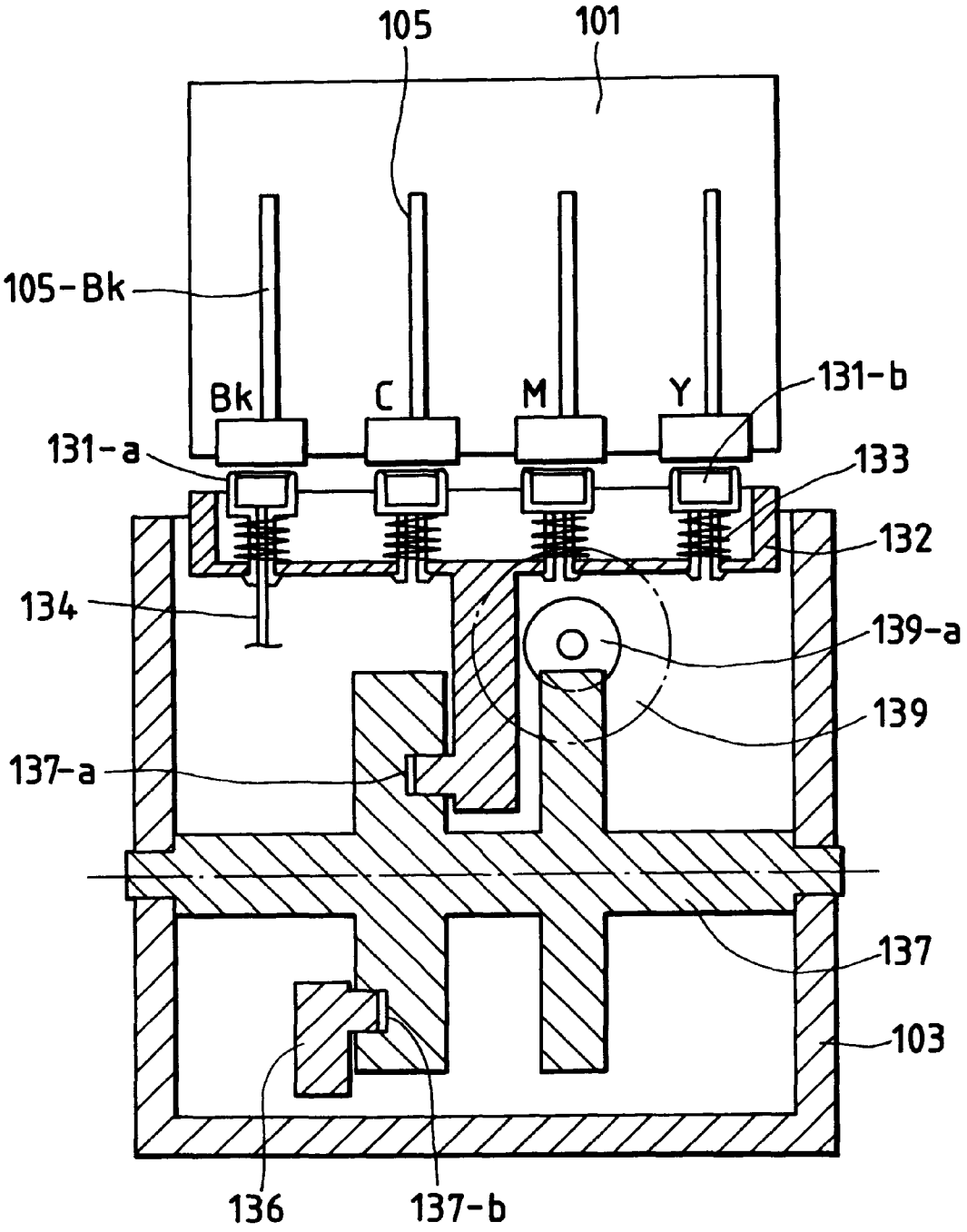
FIG. 19 is a cross-sectional view along a line A—A in FIG. 18.

FIG. 18 is a perspective view of an embodiment of the recovery mechanism for the recording head, in the ink jet recording apparatus of the present invention, wherein shown are suction caps 131-*a*; protecting caps 131-*b*; a cap holder 132 for supporting said caps; a pump 135; and a lever 136 for activating said pump. FIG. 19 is a cross-sectional view along a line A—A in FIG. 18, and there are illustrated a cam gear 137 for actuating the lever, and a motor 139 for activating the cam gear.

The recovery mechanism 103 is provided at the side of the paper transporting unit, in such a home position where four recording heads of the carriage 101 are stopped, after the completion of the printing operation, opposite to four caps of the recovery mechanism. The recovery mechanism 103 is provided with the caps 131-*a*, 131-*b* for capping the nozzle-bearing faces of the recording heads 105. Said caps are supported, by springs 133, on the cap holder 132, and is rendered movable thereto at the contact with the heads, in order to achieve capping in optimum positions relative to the heads. Among the four caps, only the suction cap 131-*a* closest to the paper transporting unit is connected to a suction tube 134 and communicates with the pump 135.

The cap holder 132 is rendered movable vertically, along a cam groove 137-*a* formed on the cam gear 137. Said cam gear 137 is also provided with a cam 137-*b* linked with the lever 136, thereby causing a rotary reciprocating motion of said lever 136, thus inducing a reciprocating motion of a piston 151 of a pump 135, thus sucking the ink from the discharge ports of the recording head.

Figure 20:
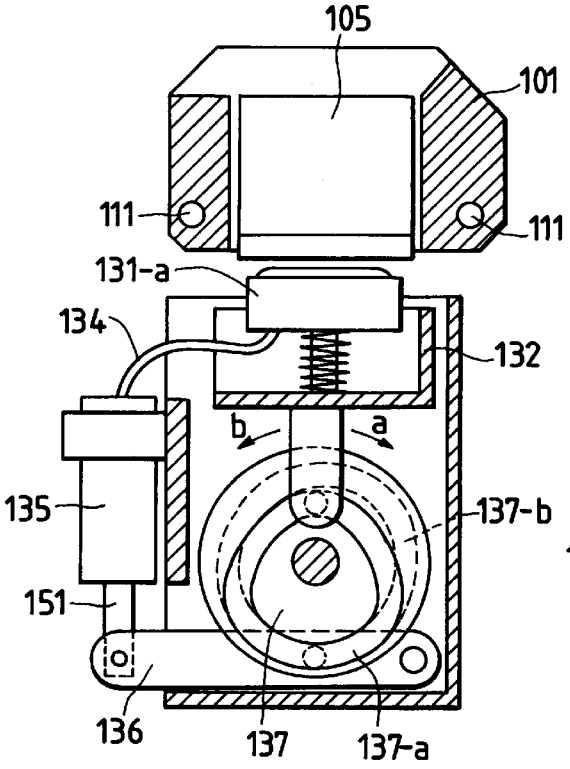
FIG. 20 is across-sectional view along a line B—B in FIG. 18.
Figure 21:
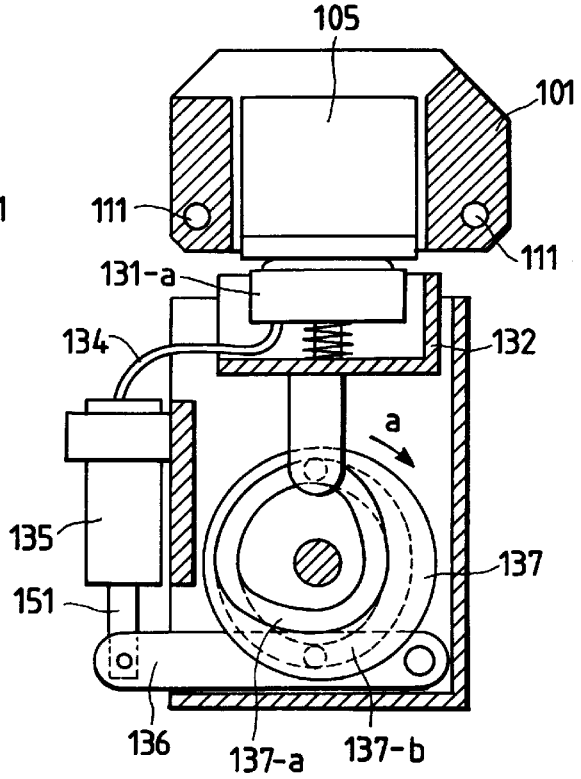
FIG. 21 is a view similar to FIG. 20, showing an ink non-sucking capping state.
Figure 24:
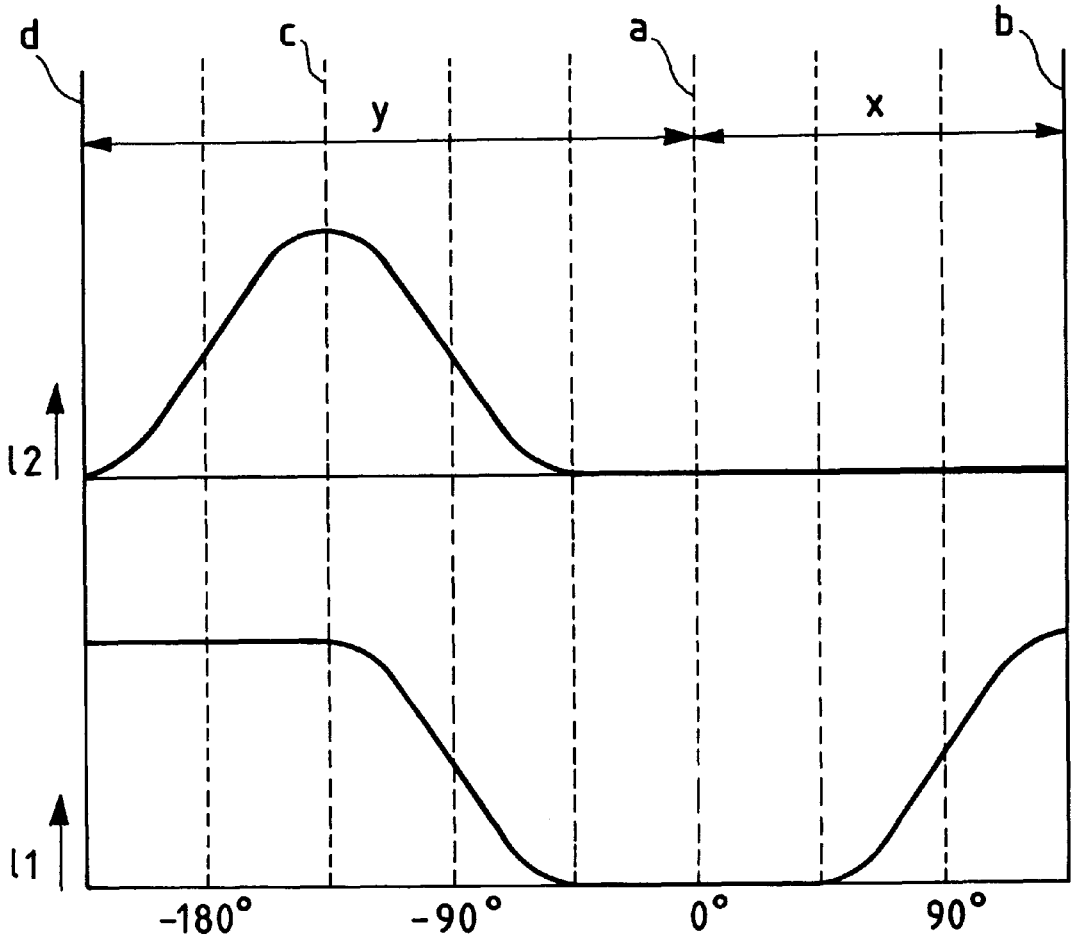
FIG. 24 is a cam chart of the gear cam of the present invention.
Figure 25:
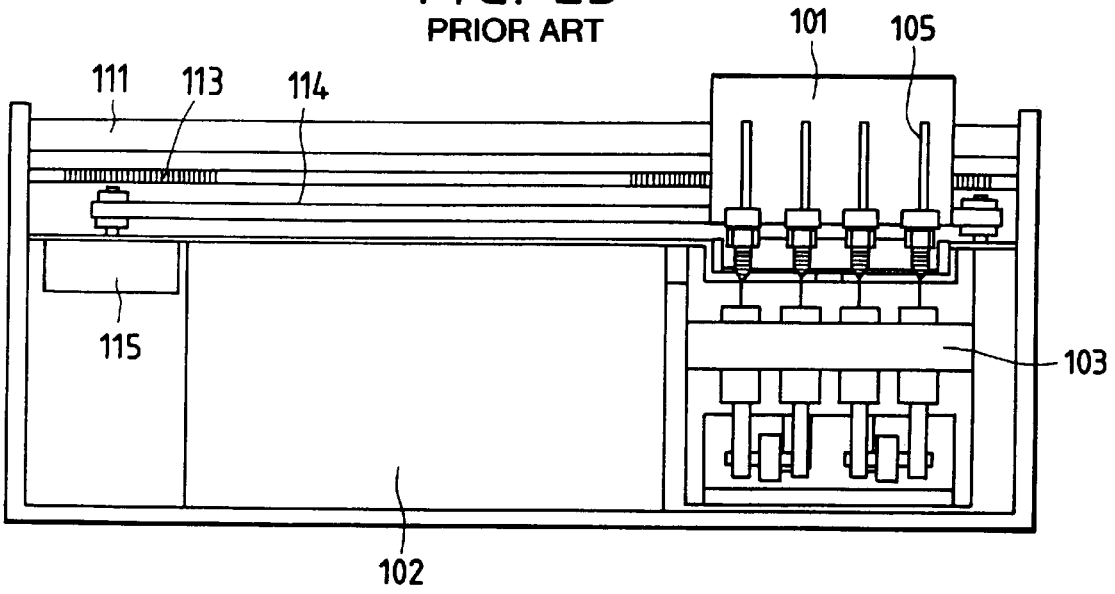
FIG. 25 PRIOR ART
FIG. 25 is a schematic view of a recording apparatus.
Figure 26:
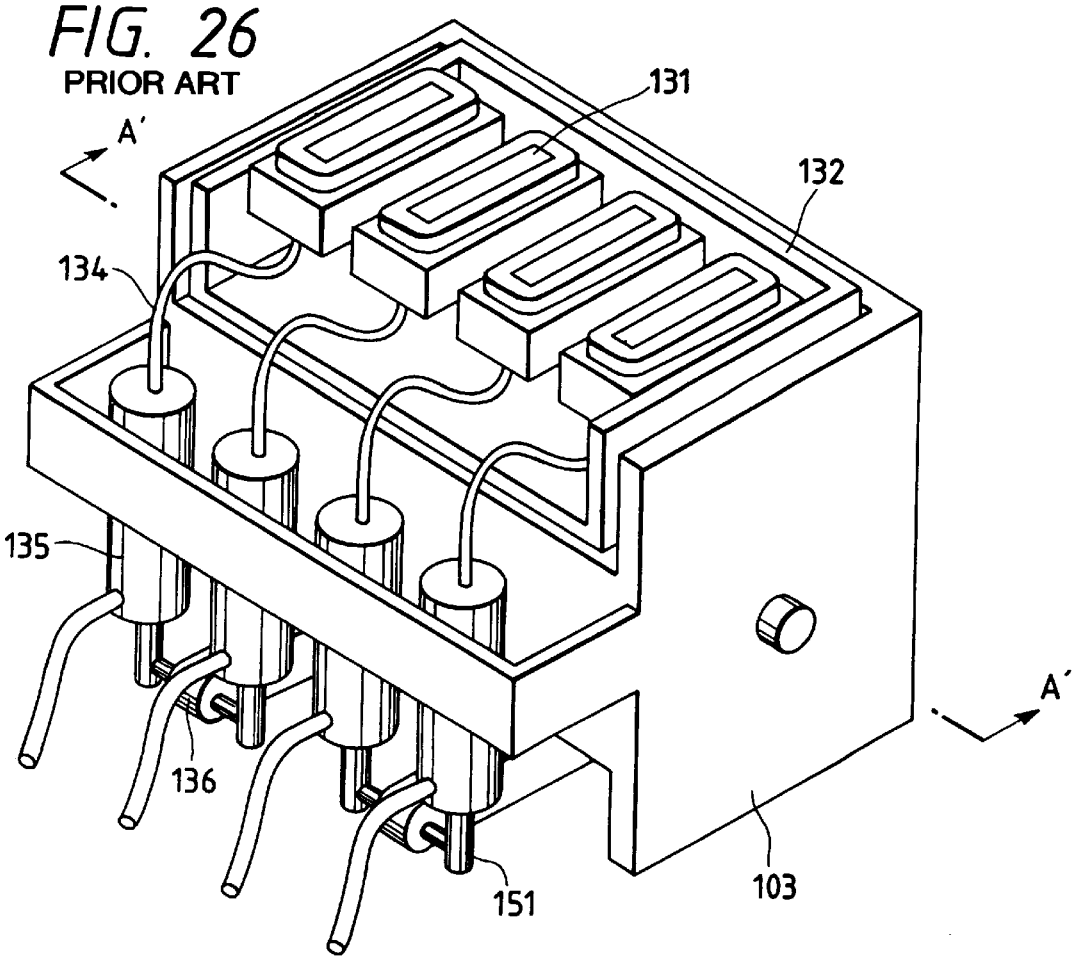
FIG. 26 PRIOR ART
FIG. 26 is a perspective view of a conventional recording apparatus.
Figure 27:
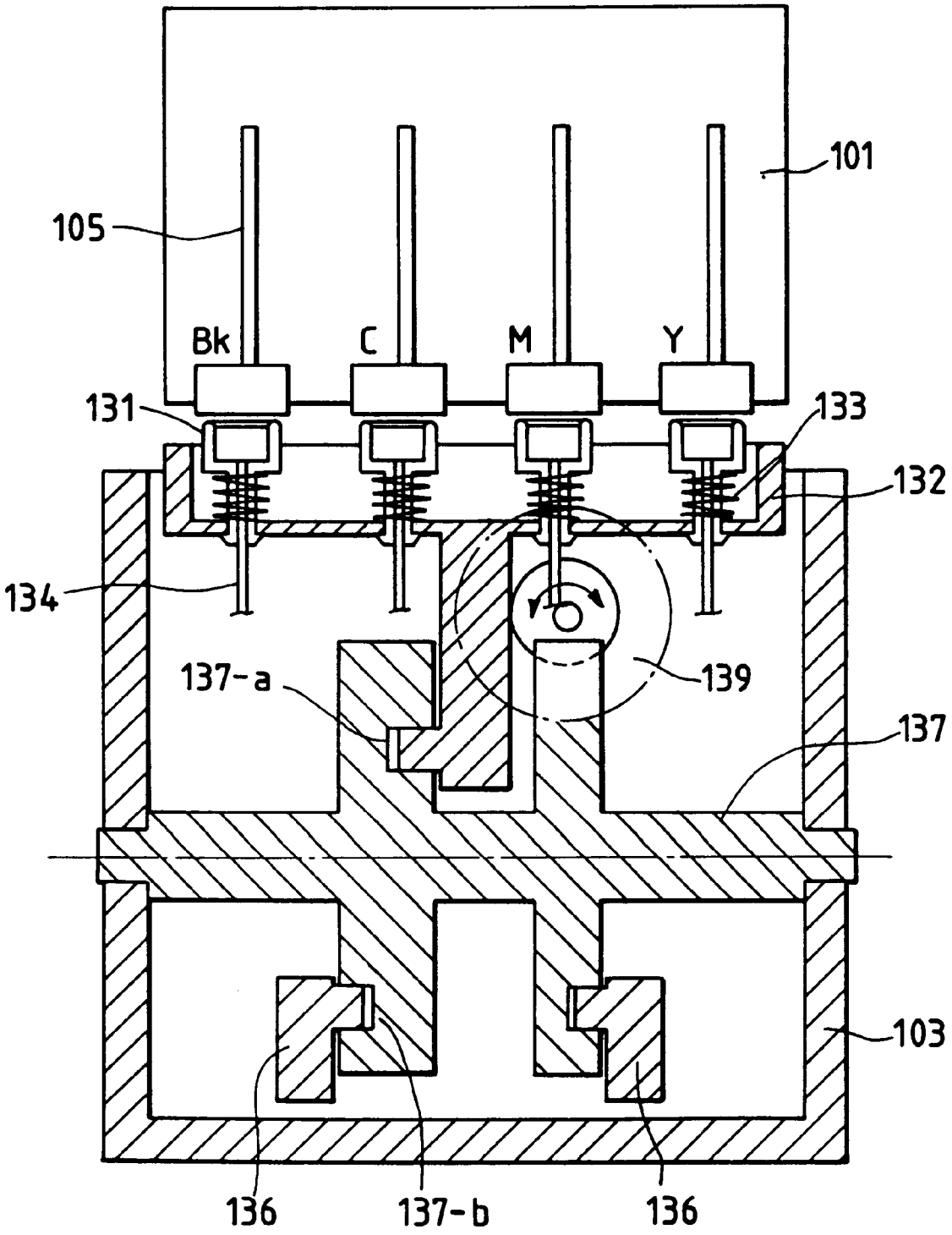
FIG. 27 PRIOR ART
FIG. 27 a cross-sectional view along a line A'—A' in FIG. 26.

The above-explained recovery mechanism functions in the following manner. During the recording operation, the cap 131-*a* is retracted from the capping position, with a cam position shown in FIG. 20. After the recording operation, the carriage 101 stops at the above-mentioned home position, opposite to the recovery mechanism. In this state, in response to a signal from the main body, a motor 139 provided in the recovery mechanism is rotated in the forward direction, whereby the cam gear 137 is rotated in a direction a, thereby elevating the cap holder 132 along the cam groove 137-*a*. In this state the piston 151 is not actuated. Consequently there is conducted a capping operation without suction, with a state shown in FIG. 21. The cam lift in this state is executed within a section x shown in FIG. 24, wherein (a) indicates a position where the cap is separated, and (b) indicates a capping position. This operation allows to prevent drying of the recording head when the recording operation is not in progress, thereby maintaining the performance of the recording head.

Figure 22:
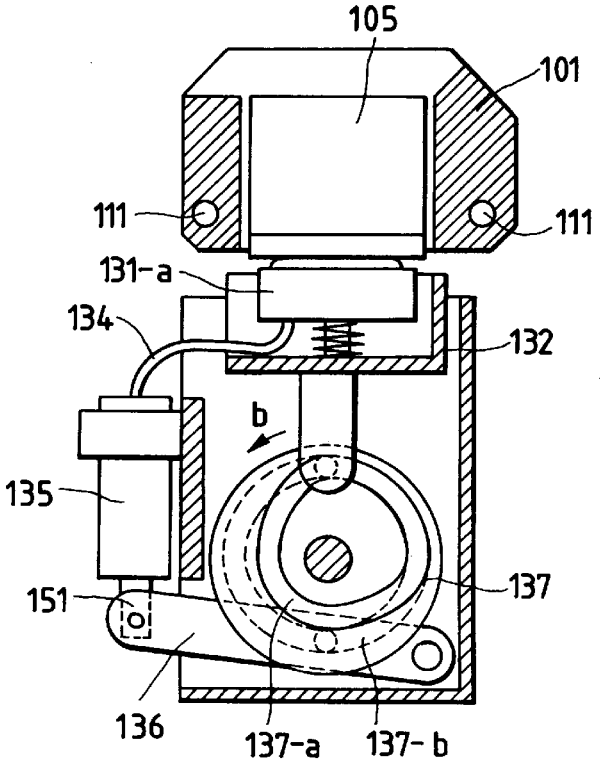
FIG. 22 is a view similar to FIG. 20, showing an ink sucking capping state.

In case of effecting a recovery operation, in order to rectify a defective ink discharge in the course of the recording operation, the carriage stops the head 105 to be subjected to the recovery operation, in a position opposite to the ink suction cap 131-*a*. For example, in case of the recovery operation for the yellow recording head 105-Y, the carriage is stopped in such a manner that said yellow recording head coincides with the suction cap 131-*a*, as shown in FIG. 22. In this state the motor 139 is inversely rotated to rotate the cam gear 137 in a direction b, whereby the cap holder is elevated and the lever 136 effects reciprocating motion along the cam groove 137-*b* formed on the lateral face of the cam gear, thereby causing the pump to such the ink from the recording head and thus recovering the performance thereof. The cam lift in this state is conducted in a section y shown in FIG. 24. The head recovery is achieved by inversion at (d) and returning to (a), thus effecting an ink suction and an idle suction (ink suction with non-contacting cap, for removing the ink remaining on the head face). Also continuous suctions can be achieved by repeating the states (c) and (d). Wasted ink consumption does not occur because the ink is not sucked from other recording heads.

Figure 23:
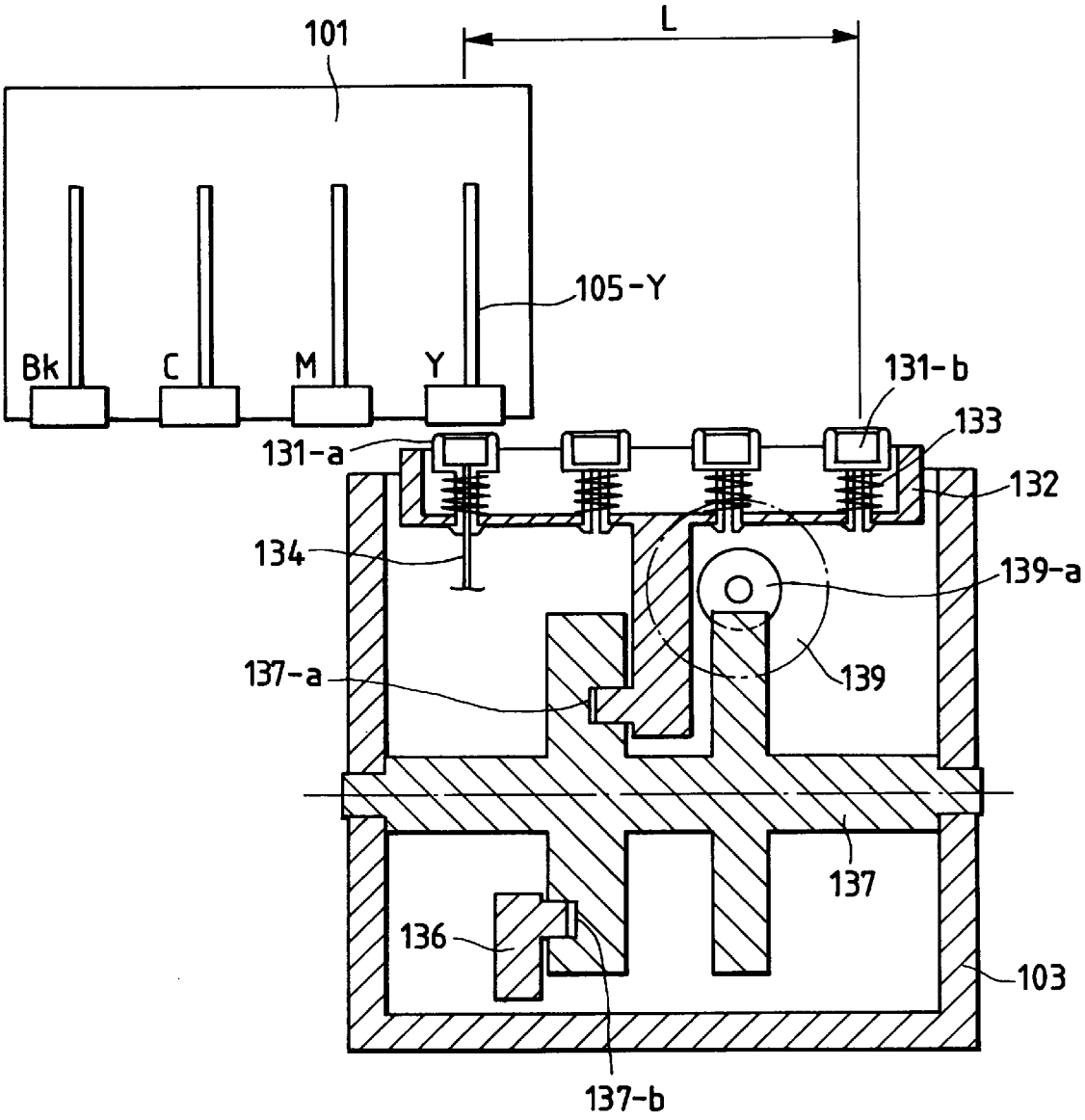
FIG. 23 is view similar to FIG. 19, showing a state of carriage stopped for sucking yellow ink.

Also the moving distance of the carriage is maintained small, as the suction cap is positioned closest to the paper transporting unit. For example, in case of the recovery operation for the yellow recording head, the moving distance is shortened by a distance L shown in FIG. 23, so that the time required for such recovery operation can be reduced.

Though the inks of four colors are mixed in the same suction cap, the influence of such ink mixing can be minimized by positioning, as shown in FIG. 19, the black recording head 105-Bk corresponding to said suction cap. In case of employing inks of three colors of cyan, magenta and yellow, a similar effect can be obtained by similarly positioning the cyan recording head.

Among various ink jet recording methods, the present invention brings about a particular effect when applied to a recording head or a recording apparatus utilizing thermal energy for ink discharge.

The principle and representative configuration of such system are disclosed, for example, in the U.S. Pat. Nos. 4,723,129 and 4,740,796. This system is applicable to so-called on-demand recording or continuous recording, but is particularly effective in the on-demand recording because, in response to the application of at least a drive signal representing the recording information to an electrothermal converter element positioned corresponding to a liquid channel or a sheet containing liquid (ink) therein, said element generates thermal energy capable of causing a rapid temperature increase exceeding the nucleus boiling point, thereby inducing film boiling on a heat action surface of the recording head and thus forming a bubble in said ink, in one-to-one correspondence with said drive signal. Said ink is discharged through a discharge port by the growth and contraction of said bubble, thereby forming at least a liquid droplet. Said drive signal is preferably formed as a pulse, as it realizes instantaneous growth and contraction of the bubble, thereby attaining highly responsive discharge of the ink.

Such pulse-shaped drive signal is preferably that disclosed in the U.S. Pat. Nos. 4,463,359 and 4,345,262. Also the conditions described in the U.S. Pat. No. 4,313,124 relative to the temperature increase rate of said head action surface allows to obtain further improved recording.

The configuration of the recording head is given by the combinations of the liquid discharge ports, liquid channels and electrothermal converter elements with linear or rectangular liquid channels, disclosed in the above-mentioned patents, but a configuration disclosed in the U.S. Pat. No. 4,558,333 in which the heat action part is positioned in a flexed area, and a configuration disclosed in the U.S. Pat. No. 4,459,600 also belong to the present invention.

Furthermore the present invention is effective in a structure disclosed in the Japanese Patent Laid-open Application No. 59-123670, having a slit common to plural electrothermal converter elements as a discharge port therefor, or in a structure disclosed in the Japanese Patent Laid-open Application No. 59-138461, having an aperture for absorbing the pressure wave of thermal energy, in correspondence with each discharge port.

The present invention is furthermore effective in a recording head of interchangeable chip type, which can receive ink supply from the main apparatus and can be electrically connected therewith upon mounting on said main apparatus, or a recording head of cartridge type in which an ink cartridge is integrally constructed with the recording head.

Also the recording apparatus is preferably provided with the emission recovery means and other auxiliary means for the recording head, since the effects of the recording head of the present invention can be stabilized further. Examples of such means for the recording head include capping means, cleaning means, pressurizing or suction means, preliminary heating means composed of electrothermal converter element and/or another heating device, and means for effecting an idle ink discharge independent from the recording operation, all of which are effective for achieving stable recording operation.

Furthermore, the present invention is not limited to a recording mode for recording a single main color such as black, but is extremely effective also to the recording head for recording plural different colors or full color by color mixing, wherein the recording head is either integrally constructed or is composed of plural units.

The foregoing embodiments of the present invention assumes the use of liquidous ink, but the present invention is applicable also to ink which is solid below room temperature but softens or liquefies at room temperature, or which softens or liquefies within a temperature control range from 30° C. to 70° C., which is ordinarily adopted in the ink jet recording. Thus the ink only needs to be liquidous when the recording signal is given.

Besides the present invention can employ ink liquefied by thermal energy provided corresponding to the recording signal, such as the ink in which the temperature increase by thermal energy is intentionally absorbed by the state change from solid to liquid, or the ink which remains solid in the unused state for the purpose of prevention of ink evaporation, or the ink which starts to solidify upon reaching the recording sheet. In these cases the ink may be supported as solid or liquid in recesses or holes of a porous sheet, as described in the Japanese Patent Laid-open Application Nos. 54-56847 and 60-71260, and placed in an opposed state to the electrothermal converter element. The present invention is most effective when the above-mentioned film boiling is induced in the ink of the above-mentioned forms.

Furthermore, the recording apparatus of the present invention may be formed as an integral or separate image output terminal of an information processing equipment such as a word processor or a computer, or as a copying machine in combination with an image reader, or a facsimile apparatus having the functions of signal transmission and reception.

What is claimed is:

1. An ink jet recording apparatus for effecting recording by discharging ink from plural discharge ports, comprising:

a plural number of caps for covering said plural discharge ports;

suction means for sucking ink from said discharge ports through said caps; and a cap lever having an ink inlet, the ink inlet for receiving ink sucked by said suction means, wherein, out of the plural number of said caps, only a selected number of said caps are engaged with said suction means, said suction means is selectively connectable to said engaged number of said plural caps to perform selective suction recovery from respective ones of said plural discharge ports, and each of said plural caps includes a valve, and wherein, during sucking by the suction means, said cap lever pushes the valve to open the valve and the ink inlet receives ink sucked by suction means.

2. An ink jet recording apparatus according to claim 1, wherein only one suction means is provided in common to said plural caps.

3. An ink jet recording apparatus according to claim 1, wherein the recording is effected using a number of different inks and the number of said caps corresponds to the number of different inks.

4. An ink jet recording apparatus according to claim 3, wherein said different inks have different colors.

5. An ink jet recording apparatus according to claim 4, wherein said different inks are color inks of black, cyan, magenta and yellow colors.

6. An ink jet recording apparatus according to claim 3, wherein said different inks have different luminocities.

7. An ink jet recording apparatus according to claim 1, further comprising a blade capable of contacting a face on which said discharge ports are formed.

8. An ink jet recording apparatus according to claim 7, wherein said blade can be moved in relation with the function of said suction means.

9. An ink jet recording apparatus according to claim 7, wherein said blade is formed integrally with said cap.

10. An ink jet recording apparatus according to claim 1, further comprising an absorbent member capable of contacting a face on which said discharge ports are formed.

11. An ink jet recording apparatus according to claim 10, wherein said absorbent member can be moved in relation with the function of said suction means.

12. An ink jet recording apparatus according to claim 1, wherein said apparatus discharges ink from said discharge ports without effecting recording.

13. An ink jet recording apparatus according to claim 12, further comprising an ink receiving member for receiving the ink discharged from said discharge ports.

14. An ink jet recording apparatus according to claim 13, wherein said ink receiving member is integral with said caps.

15. An ink jet recording apparatus according to claim 1, wherein said plural caps are capable, either individually or in combination, of capping said discharge ports.

16. An ink jet recording apparatus according to claim 1, further comprising an electrothermal converter element for generating thermal energy to be utilized for discharging ink from said discharge ports.

17. An ink jet recording apparatus according to claim 16, wherein ink discharge from said discharge ports is effected, utilizing film boiling induced in the ink by the thermal energy generated by said electrothermal converter element.

18. An ink jet recording apparatus according to claim 1, wherein said suction means is selectively connectable to each one of said plural caps in turn, to perform selective suction recovery from the respective one of said discharge ports.

* * * * *

UNITED STATES PATENT AND TRADEMARK OFFICE

CERTIFICATE OF CORRECTION

PATENT NO. : 5,903,287

DATED : May 11, 1999

INVENTORS : TETSUYA ISHIKAWA et al.

It is certified that error appears in the above-identified patent and that said Letters Patent is hereby corrected as shown below:

Title page, under

References Cited

FOREIGN PATENT DOCUMENTS

| | | |
|---|---|---|
| "WO91/10570 | 7/1991 | Germany" should read |
| --WO91/10570 | 7/1991 | WIPO--; and |
| "59-045163 | 3/1982 | Japan" should read |
| --59-045163 | 3/1984 | Japan--. |

COLUMN 18

Line 14, "luminocities" should read --luminosities--.

Signed and Sealed this

Twenty-third Day of November, 1999

*Attest:*

*Attesting Officer*

Q. TODD DICKINSON

*Acting Commissioner of Patents and Trademarks*